US007604225B2

(12) United States Patent
Fukatsu et al.

(10) Patent No.: US 7,604,225 B2
(45) Date of Patent: Oct. 20, 2009

(54) SHEET PROCESSING APPARATUS AND IMAGE FORMING APPARATUS

(75) Inventors: Yasuo Fukatsu, Abiko (JP); Yushi Oka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 310 days.

(21) Appl. No.: 11/466,857

(22) Filed: Aug. 24, 2006

(65) Prior Publication Data

US 2007/0045926 A1 Mar. 1, 2007

(30) Foreign Application Priority Data

Aug. 31, 2005 (JP) ..... 2005-252032

(51) Int. Cl.
*B65H 37/04* (2006.01)

(52) U.S. Cl. ..... 270/32; 270/20.1; 270/37; 270/58.07

(58) Field of Classification Search ..... 270/20.1, 270/32, 37, 58.07
See application file for complete search history.

(56) References Cited

U.S. PATENT DOCUMENTS

| | | | | |
|---|---|---|---|---|
| 6,905,118 | B2 | 6/2005 | Yamada | 270/8 |
| 2005/0063023 | A1 | 3/2005 | Komatsu et al. | 358/488 |
| 2005/0179190 | A1 * | 8/2005 | Kamiya et al. | 270/58.07 |
| 2005/0189689 | A1 * | 9/2005 | Kushida et al. | 270/37 |

FOREIGN PATENT DOCUMENTS

| | | |
|---|---|---|
| JP | 2005-089100 | 4/2005 |

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

This invention can improve the appearance quality of a pamphlet produced by suppressing a swell of a folded sheet bundle and prevent a drop in productivity without enlarging the size of a sheet processing apparatus. A sheet bundle receiving position is changed depending on a sheet size and the moving direction of the press unit is changed corresponding to the sheet size of a conveyed sheet bundle. As a consequence, the enlargement of the sheet processing apparatus can be avoided without deteriorating productivity.

9 Claims, 18 Drawing Sheets

FIG. 13

| | PRESS ROLLER MOVING SPEED | |
|---|---|---|
| SHIFT ROLLER RETRACTION SPEED | A | FAST |
| QUANTITY OF SHEETS IN A BUNDLE 1 TO 10 SHEETS | B | ↕ |
| QUANTITY OF SHEETS IN A BUNDLE 11 TO 20 SHEETS | C | |
| QUANTITY OF SHEETS IN A BUNDLE 21 TO 30 SHEETS | D | SLOW |

SHEET PROCESSING APPARATUS AND IMAGE FORMING APPARATUS

BACKGROUND OF THE INVENTION

1. Field of the Invention

The present invention relates to a sheet processing apparatus and an image forming apparatus and particularly, is preferably applied to a sheet processing apparatus for use in the image forming apparatus such as a copying machine, or a laser beam printer.

2. Description of the Related Art

Conventionally, a book-binding machine which binds sheets discharged from an image forming apparatus such as a copying machine, or a laser beam printer into each sheet bundle and folds the bound sheets into a pamphlet by a folding roller has been provided.

However, when a book binding process is carried out on a sheet bundle comprised of a multiplicity of sheets or sheets having a high rigidity by such sheet processing apparatus, a portion folded by a folding roller sometimes may be swollen thereby the quality dropping as shown in FIG. 16.

Thus, to press the swelling of the folded portion, as shown in FIG. 17, there has been available a method of pressing the folded portion to intensify its folding to reduce the swelling by moving a press roller (pair of press rollers 1201) over the folded portion (see Japanese Patent Application Laid-Open No. 2005-089100). This patent document describes technology for suppressing the swelling of the folded sheet bundle.

However, in recent years, in the image forming apparatus including the sheet processing apparatus, increase of production has been demanded regardless of the sheet size. Further, the sizes of the image forming apparatus and the sheet processing apparatus need to be suppressed to minimum ones.

FIG. 18A shows a state in which a folded sheet bundle S100 long in its width direction is discharged from a pair of discharge rollers 827. The right side of FIG. 18A is the front side of the apparatus and the left side is its rear side. In the conventional press operation, if the standby position of a press unit 1200 exists on the rear side (left side in FIG. 18) of the apparatus, after the sheet bundle S100 advances into the press unit 1200, the press unit 1200 moves to the front side (right side in FIG. 18) while the folded portion of the sheet bundle S100 is pressurized by the pair of the press rollers 1201.

After the press operation is finished, as shown in FIG. 18C, the press unit 1200 is moved to the front position of the apparatus which allows the sheet bundle S100 to be discharged in order to discharge the sheet bundle into a discharge tray. However, this state requires the length in the width direction of the apparatus to be increased by the size L1 of the press unit 1200 thereby enlarging the apparatus.

On the other hand, although a method of returning the press unit 1200 to a position which allows the sheet bundle S100 to be discharged (rear side of the apparatus), this method takes a time for the press unit to return to its original position thereby inducing a drop in productivity.

SUMMARY OF THE INVENTION

Accordingly, an object of the present invention is to provide a sheet processing apparatus and an image forming apparatus capable of improving the appearance quality of a pamphlet produced by suppressing a swell of a folded sheet bundle and preventing a drop in productivity without enlarging the size of the same sheet processing apparatus.

To achieve above-mentioned object, a first aspect of the present invention provides a sheet processing apparatus comprising:

a folding unit which executes folding process on a sheet bundle comprised of a plurality of sheets;

a sheet bundle pressurizing unit which pressurizes the folded portion of the sheet bundle folded by the folding unit when it moves from an end portion of the sheet bundle to the other end portion along the folded portion of the folded sheet bundle; and a controller which controls the sheet bundle pressurizing unit, wherein the sheet bundle pressurizing unit is movable between a sheet bundle receiving position which receives a folded sheet bundle with a folded portion ahead and a sheet bundle discharge enable position which enables the sheet bundle after pressurized to be discharged with the folded portion ahead and the controller controls whether the sheet bundle discharge enable position of the sheet bundle pressurizing unit is set to an end portion side or the other end portion side of the sheet bundle or both corresponding to a sheet size in a direction perpendicular to the receiving direction of the sheet bundle.

The second aspect of the present invention provides an image forming apparatus comprising:

an image forming portion which forms an image on a sheet; and the sheet processing apparatus according to the first aspect of the present invention which processes a sheet on which an image is formed.

The third aspect of the present invention provides an image forming apparatus comprising:

an image forming portion which forms an image on a sheet;

a folding unit which executes folding process on a sheet bundle comprised of a plurality of sheets on which an image is formed;

a sheet bundle pressurizing unit which pressurizes the folded portion of the sheet bundle folded by the folding unit when it moves from an end portion of the sheet bundle to the other end portion along the folded portion of the folded sheet bundle; and a controller which controls the sheet bundle pressurizing unit, wherein the sheet bundle pressurizing unit is movable between a sheet bundle receiving position which receives a folded sheet bundle with a folded portion ahead and a sheet bundle discharge enable position which enables the sheet bundle after pressurized to be discharged with the folded portion ahead and the controller controls whether the sheet bundle discharge enable position of the sheet bundle pressurizing unit is set to an end portion side or the other end portion side of the sheet bundle or both corresponding to a sheet size in a direction perpendicular to the receiving direction of the sheet bundle.

As described above, the present invention can improve the appearance quality of a pamphlet produced by suppressing a swell of a folded sheet bundle and prevent a drop in productivity without enlarging the size of a sheet processing apparatus.

Further features of the present invention will become apparent from the following description of exemplary embodiments (with reference to the attached drawings).

BRIEF DESCRIPTION OF THE DRAWINGS

The invention, together with further advantages thereof, may best be understood by reference to the following description taken in conjunction with the accompanying drawings in which:

FIG. 13 is a velocity table showing a moving velocity of a shift roller according to the embodiment of the present invention;

DESCRIPTION OF THE EMBODIMENTS

Figure 1:
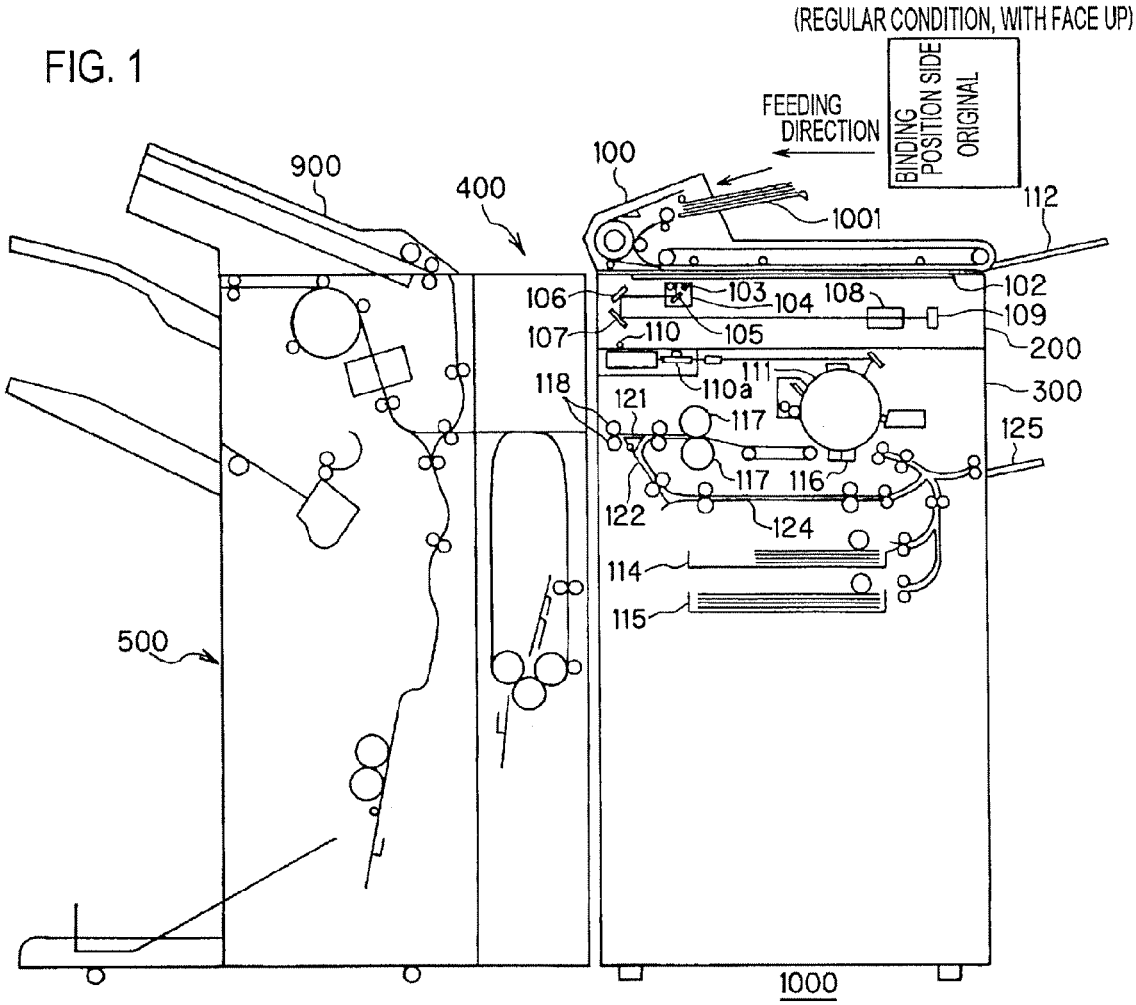
FIG. 1 is a sectional view showing an example of a copying machine according to an embodiment of the present invention.

Hereinafter, the preferred embodiment of the present invention will be described with reference to the accompanying drawings. Like reference numerals are attached to the same components as or corresponding ones in all drawings of the embodiment.

FIG. 1 shows a copying machine 1000 of the embodiment of the present invention. The copying machine 1000 of this embodiment comprises a document conveying portion 100, an image reading portion 200, a printer portion 300, a folding process portion 400, a finisher 500 as a sheet processing apparatus and an inserter 900.

Assume that in FIG. 1, originals are set in a tray 1001 of a document conveying portion 100 in a regular condition with its face facing up (with a face on which an image is formed facing upward) as viewed from user's perspective. Further, assume that an original binding position is left end of the original. Originals set in the tray 1001 are conveyed one by one with their front end in the leftward direction (direction of an arrow in FIG. 1) successively from a head page by the document conveying portion 100. That is, the originals are conveyed with the binding position ahead.

This original is conveyed in the right direction from the left direction on a platen glass 102 through a curve path and discharged onto a discharge tray 112. At this time, a scanner unit 104 is held at a predetermined position. When the original passes over the scanner unit 104 from the left to the right, a reading process of the original is executed. This original reading method is called original skimming.

When the original passes over the platen glass 102, the original is irradiated by a lamp 103 of the scanner unit 104. Reflection light from this original is introduced to an image sensor 109 through mirrors 105, 106, 107 and a lens 108.

The original conveyed by the original conveying portion 100 is stopped on the platen glass 102 temporarily and with this condition, the scanner unit 104 is moved from the left to the right. Consequently, the original reading process is carried out. This reading method is called original fixed reading. To read the original without use of the original conveying portion 100, the user raises the original conveying portion 100 and sets an original on the platen glass 102 to execute the original fixed reading.

Image data of original read by the image sensor 109 undergoes a predetermined image process and is conveyed to an exposure controller 110. Laser beam corresponding to the image signal is outputted from the exposure controller 110. This laser beam is projected to a photosensitive drum 111 such that it is scanned with the laser beam by a polygon mirror 110*a*. Consequently, an electrostatic latent image is formed on the photosensitive drum 111 corresponding to the projected laser beam.

The electrostatic latent image formed on the photosensitive drum 111 is developed by a development unit so that it is visualized as a toner image. On the other hand, recording paper is conveyed to a transfer unit 116 from cassettes 114, 115, manual paper feed portion 125 or sheet re-feeding path 124. The visualized toner image is transferred to the recording paper by this transfer unit 116. Fixing treatment is executed on the recording paper after the transfer by the fixing portion 117.

The recording paper after passing the fixing portion 117 is conveyed to a path 122 by a flapper 121. The recording paper is switched back after the rear end thereof passes the flapper 121 and conveyed to the discharge roller 118 by the flapper 121.

This recording paper is discharged from the printer portion 300 by the discharge roller 118. As a consequence, the recording paper is discharged from the printer portion 300 with a face on which a toner image is formed facing down. This is called reverse discharging.

By discharging the recording paper with the face in which the image is formed facing down, page order can be secured in case of executing an image formation process in order from a head page, for example, case where the image formation process is carried out using the original conveying portion 100 or case of executing the image formation process on image data from computer. If a hard sheet such as OHP is conveyed from the manual paper feed portion 125 to execute the image formation process, the recording paper is discharged from the printer portion 300 by the discharge roller 118 with the face on which the toner image is formed facing up without being introduced to a path 122.

To carry out image formation process on both sides of the recording paper, the recording paper is introduced straight to the discharge roller 118 from the fixing portion 117. Just after the rear end of the sheet passes the flapper 121, the sheet is switched back and introduced to the sheet re-feeding path by the flapper 121.

The sheet discharged from the printer portion 300 by the discharge roller 118 is fed to a folding process portion 400. The folding process portion 400 carries out a folding process to fold the sheet into Z-shape. In case of sheets of size A3 or B4, a sheet discharged form the printer portion 300 undergoes the folding process if folding process is instructed from an operation panel. On the other hand, in other cases, the sheet discharged from the printer portion 300 is conveyed to the finisher 500 without undergoing the folding process.

Figure 8:
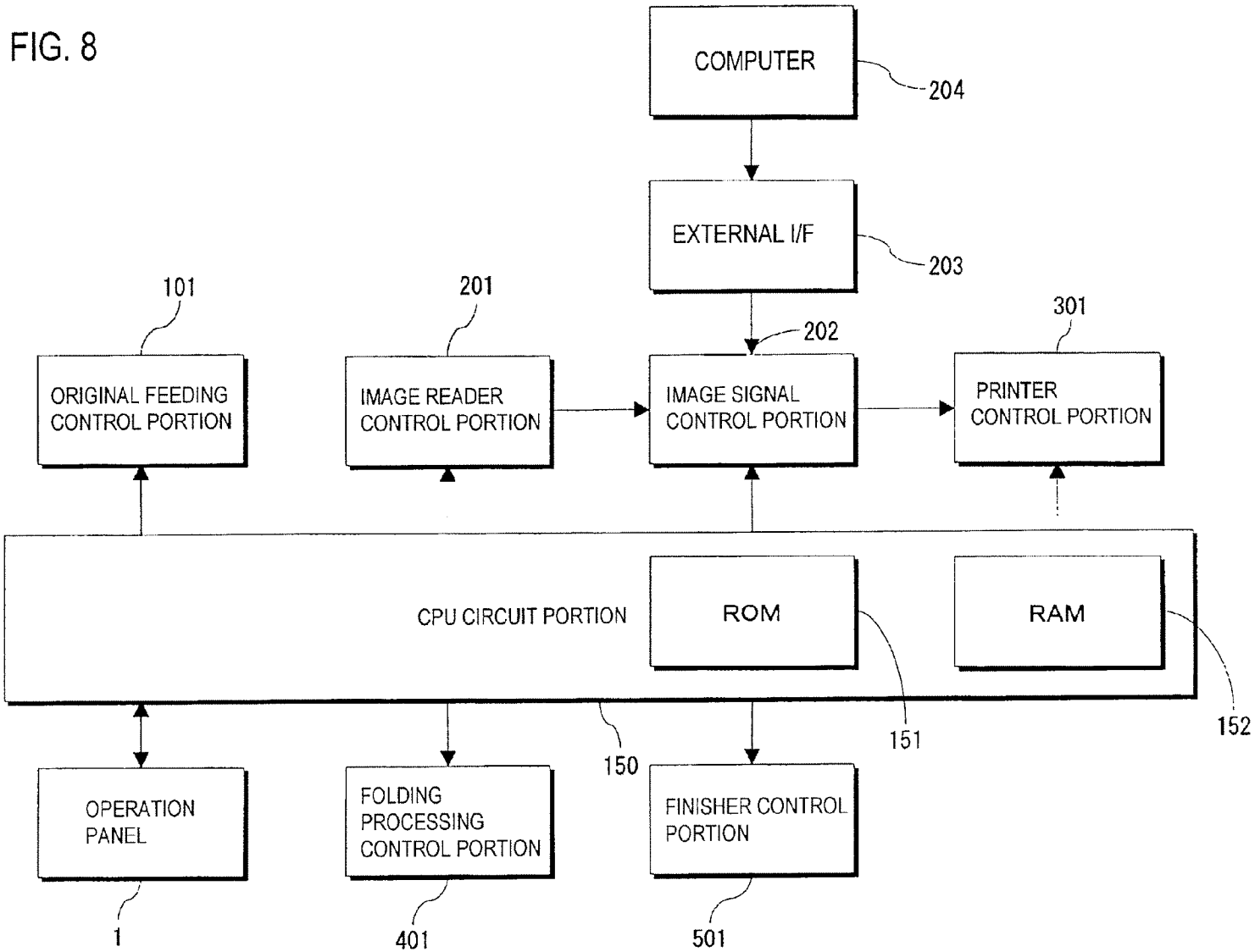
FIG. 8 is a block diagram of a copying machine according to an embodiment of the present invention.

Next, the control method of the copying machine will be described. FIG. 8 shows the configuration of the control circuit of a copying machine 1000 which is constituted around a CPU circuit portion 150. The CPU circuit portion 150 includes a CPU (not shown) as information process portion. The CPU circuit portion 150 includes a ROM 151 as read only recording portion and a RAM 152 as a rewritable recording portion.

This CPU circuit portion 150 is so constructed to be capable of executing various controls according to a control program stored in the ROM 151 and a setting signal supplied from the operation panel 1. That is, a document conveyance control portion 101, an image reading control portion 201, an image signal control portion 202, a printer control portion 301, a folding process control portion 401, a finisher control portion 501 and an external I/F 203 are controlled by the CPU circuit portion 150.

The document conveying portion 100 is controlled by the document conveyance control portion 101. The image reading portion 200 is controlled by the image reading control portion 201. The printer portion 300 is controlled by the printer control portion 301. The folding process portion 400 is controlled by the folding process control portion 401. The finisher 500 is controlled by the finisher control portion 501.

The operation panel 1 includes a plurality of keys for setting various functions relating to image formation and a display portion for displaying a setting condition. Then, a key signal corresponding to operation of each key by user is supplied from the operation panel 1 to the CPU circuit portion 150. The display portion provided on the operation panel 1 displays corresponding information based on a signal from the CPU circuit portion 150. In this embodiment, a face of the apparatus opposing the user when he operates facing the operation panel 1 is called front face of the apparatus and its opposite side is called rear face thereof.

The RAM 152 is used as an area for storing control data temporarily or an area for arithmetic operation accompanying the control. The external I/F 203 is an interface between the copying machine 1000 and a computer 204 outside. This external I/F 203 develops print data from the computer 204 to bit map image and supplies to the image signal control portion 202 as image data.

An image of original read by the image sensor 109 is supplied from the image reading control portion 201 to the image signal control portion 202. The printer control portion 301 supplies image data supplied from the image signal control portion 202 to the exposure controller 110.

Next, the structure of the finisher 500 shown in FIG. 1 will be described. As shown in FIG. 1, the finisher 500 executes sheet post processing such as binding into a sheet bundle. That is, recording papers from the printer portion 300 are fetched into the finisher 500 through the folding process portion 400 and a plurality of sheets are arranged and bound into a sheet bundle.

Further, the finisher 500 can execute post processings such as a stapling process of stapling the rear end of the sheet bundle, sorting process, non-sorting process and book binding process.

Figure 2:
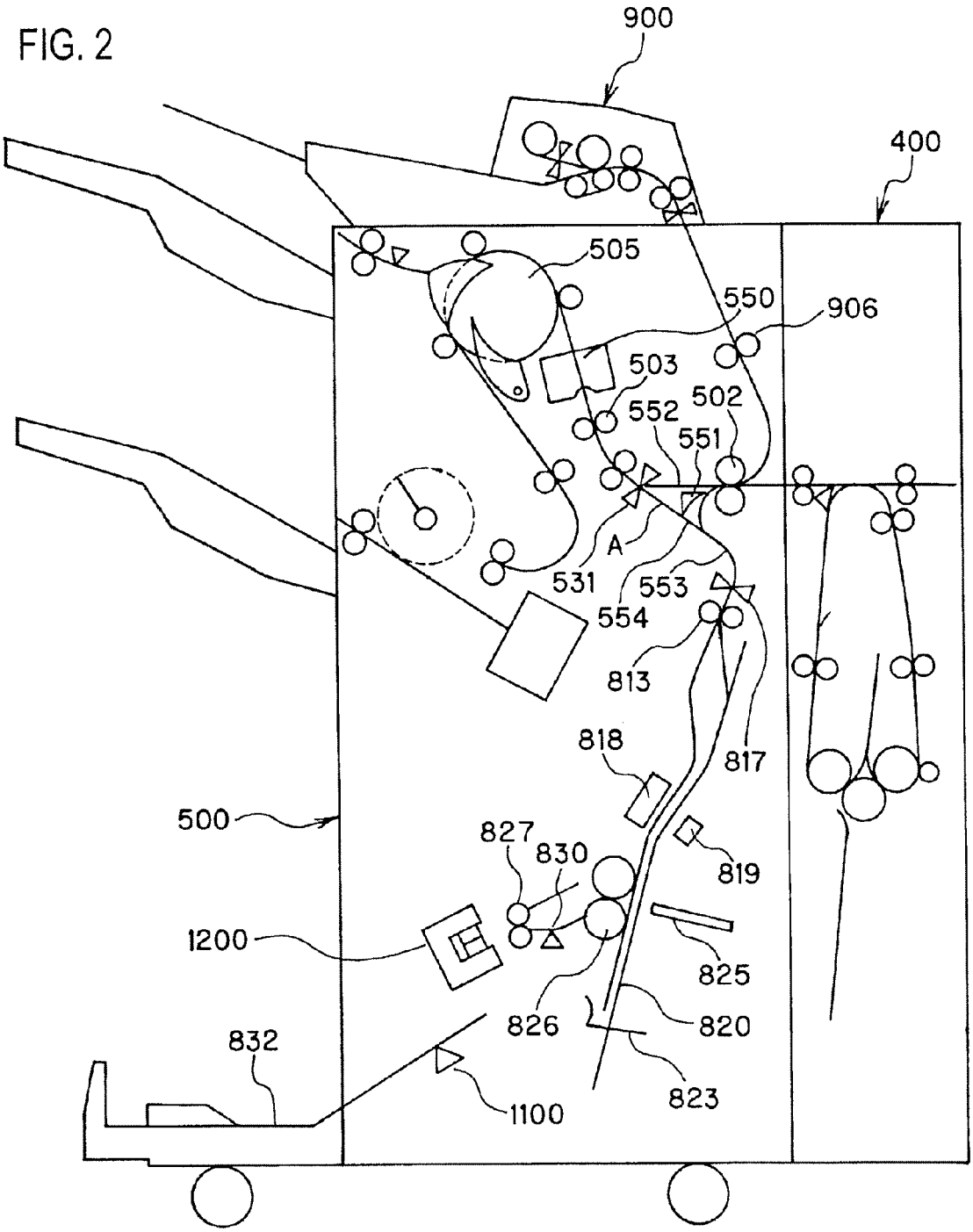
FIG. 2 is a sectional view showing the structure of a finisher according to the embodiment of the present invention.

Further, as shown in FIG. 2, it is permissible to provide a punch portion 550 on a sheet conveyance passage within the finisher 500 so as to punch sheets from the inserter 900 or the printer portion 300.

As shown in FIG. 2, the finisher 500 has a pair of entrance rollers 502. The pair of the entrance rollers 502 fetches a sheet conveyed from the printer portion 300 through the folding process portion 400 into the finisher 500. A switching flapper 551 for introducing the sheet to a finisher path 552 or a first book binding path 553 is provided in the downstream of the pair of the entrance rollers 502.

The sheet introduced to the finisher path 552 is conveyed to a buffer roller 505 through a pair of conveyance rollers 503. In the meantime, the pair of the conveyance rollers 503 and the buffer roller 505 can rotate in the normal direction and in an inverse direction.

An entrance sensor 531 is provided between the pair of the entrance rollers 502 and the pair of the conveyance rollers 503. A second book binding path 554 is branched from the finisher path 552 near the upstream of the entrance sensor 531. Hereinafter, this branch point is called branch A.

The branch A is a branch to a conveyance path for conveying the sheet from the pair of the entrance rollers 502 to the pair of the conveyance rollers 503. When the sheet is conveyed from the pair of the conveyance rollers 503 side to the side of the entrance sensor 531 side by rotating the pair of the conveyance rollers 503 inversely, the sheet is conveyed to only the side of the second book binding path 554 side. The branch has a one-way mechanism.

The sheet from the first book binding path 553 or the second book binding path 554 passes a book binding entrance sensor 817 and stored in a storage guide 820 through a pair of book binding rollers 813. In the meantime, the sheet conveyed by the pair of the book binding rollers 813 is conveyed until the front end of the sheet comes into contact with a movable sheet positioning member 823.

Two pairs of staplers 818 are provided in the downstream of the pair of the book binding rollers 813, that is, halfway to the storage guide 820. An anvil 819 is provided at a position opposing this stapler 818. The stapler 818 is so constructed to staple the center of a sheet bundle S100 in cooperation with the anvil 819.

A pair of folding rollers 826 constituting a folding unit is provided in the downstream of the stapler 818. A thrust member 825 constituting the folding unit is provided at a position opposing the pair of the folding rollers 826. When this thrust member 825 is thrust to the sheet bundle stored in the storage guide 820, this sheet bundle is pushed into between the pair of the folding rollers 826. The pushed sheet bundle S100 is conveyed while folded by the pair of the folding rollers 826.

After that, the conveyance of the sheet bundle is stopped temporarily. A press unit 1200 as a sheet bundle pressurizing unit is moved in a direction perpendicular to the conveyance direction. After that, a press process for crushing a folded portion of the sheet bundle is executed. In the meantime, this press unit 1200 is comprised of a pair of press rollers 1201, columns for supporting this pair of the press rollers 1201 and outer sheath.

After that, the sheet bundle S100 is discharged onto a discharge tray 832 as a loading portion through a pair of discharge rollers 827 as a discharge portion. A book binding discharge sensor 830 is provided in the downstream of the pair of the discharge rollers 827. A loading completion detecting sensor 1100 as a loading termination detecting portion is disposed on the discharge tray 832.

Figure 3:
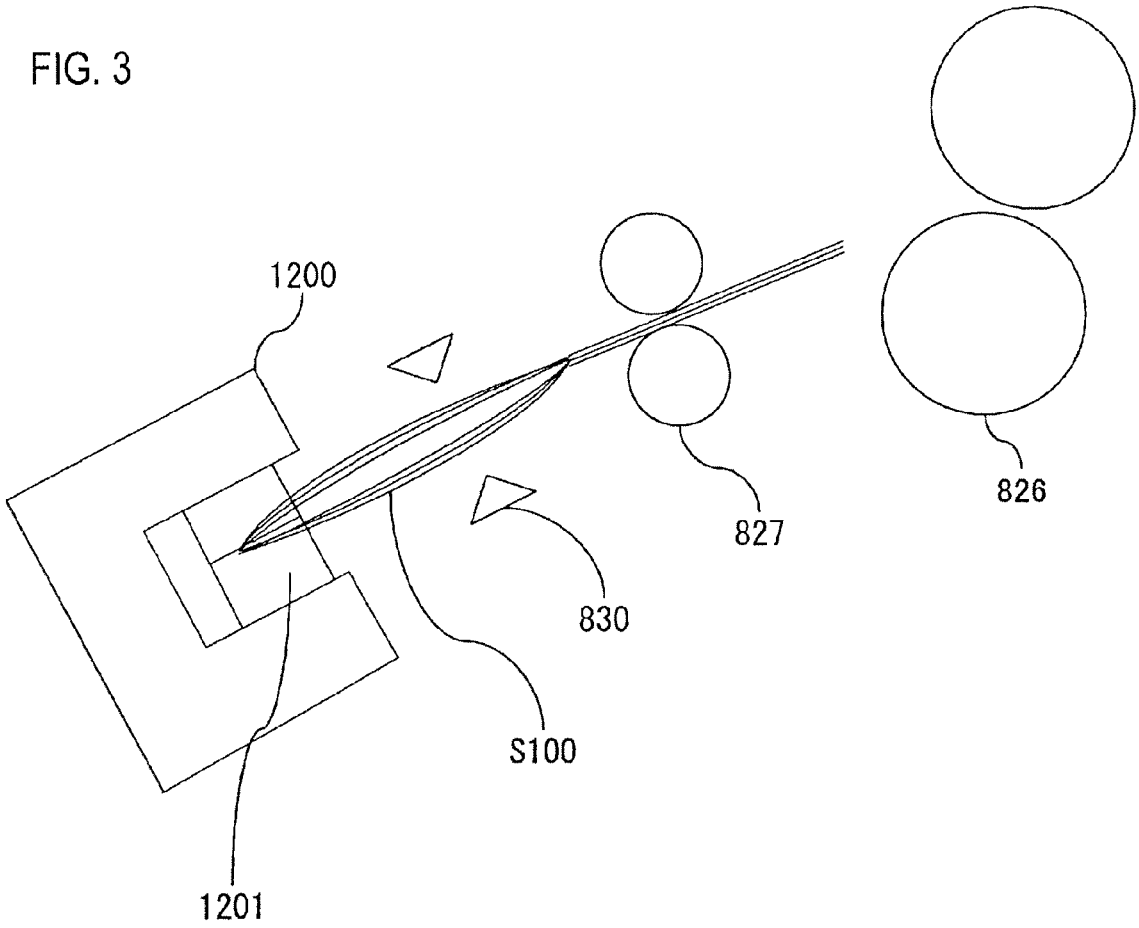
FIG. 3 is a schematic diagram showing a state in which a sheet bundle is conveyed into a press unit according to the embodiment of the present invention.

If the press unit 1200 is moved before completion of loading by the loading completion detecting sensor 1100 is detected as shown in FIG. 3, the sheet bundle collides with the press unit 1200 thereby causing a loading failure in the discharge tray 832.

Figure 4:
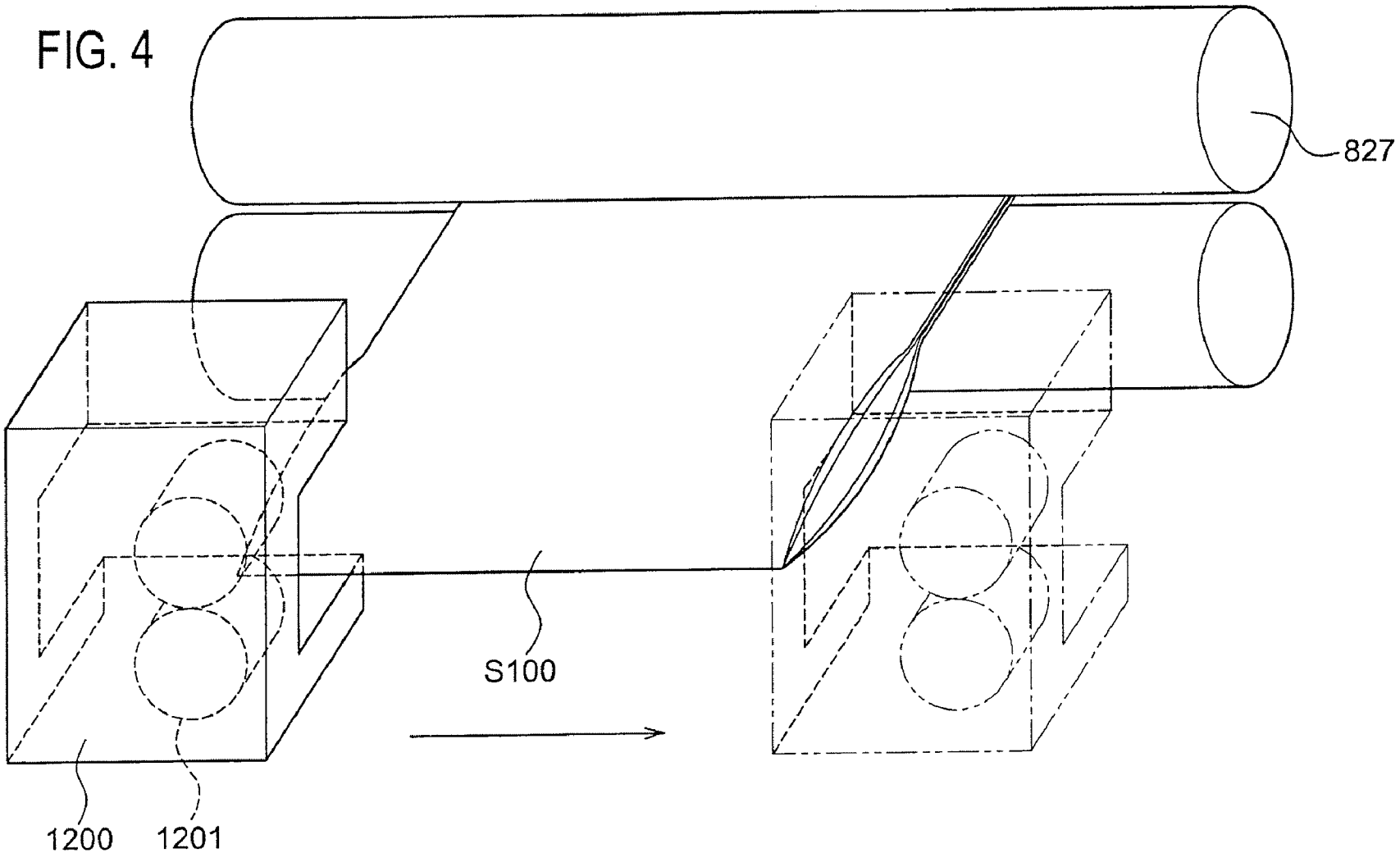
FIG. 4 is a schematic diagram of a state in which the sheet bundle is pressed with the press unit of the embodiment of the present invention.

Thus, according to this embodiment, moving of the press unit 1200 is executed after the rear end of the sheet bundle is detected by the loading completion detecting sensor 1100 as shown in FIG. 4.

When the sheet bundle bound by the stapler 818 is folded, a positioning member 823 is descended by a predetermined distance from a stapling place so that the stapled position of the sheet bundle comes to a central position (nipping position) of the pair of the folding rollers 826 after the stapling process is terminated. As a consequence, the sheet bundle can be folded with respect to the position which undergoes the stapling process.

(Finisher Control Portion)

Figure 9:
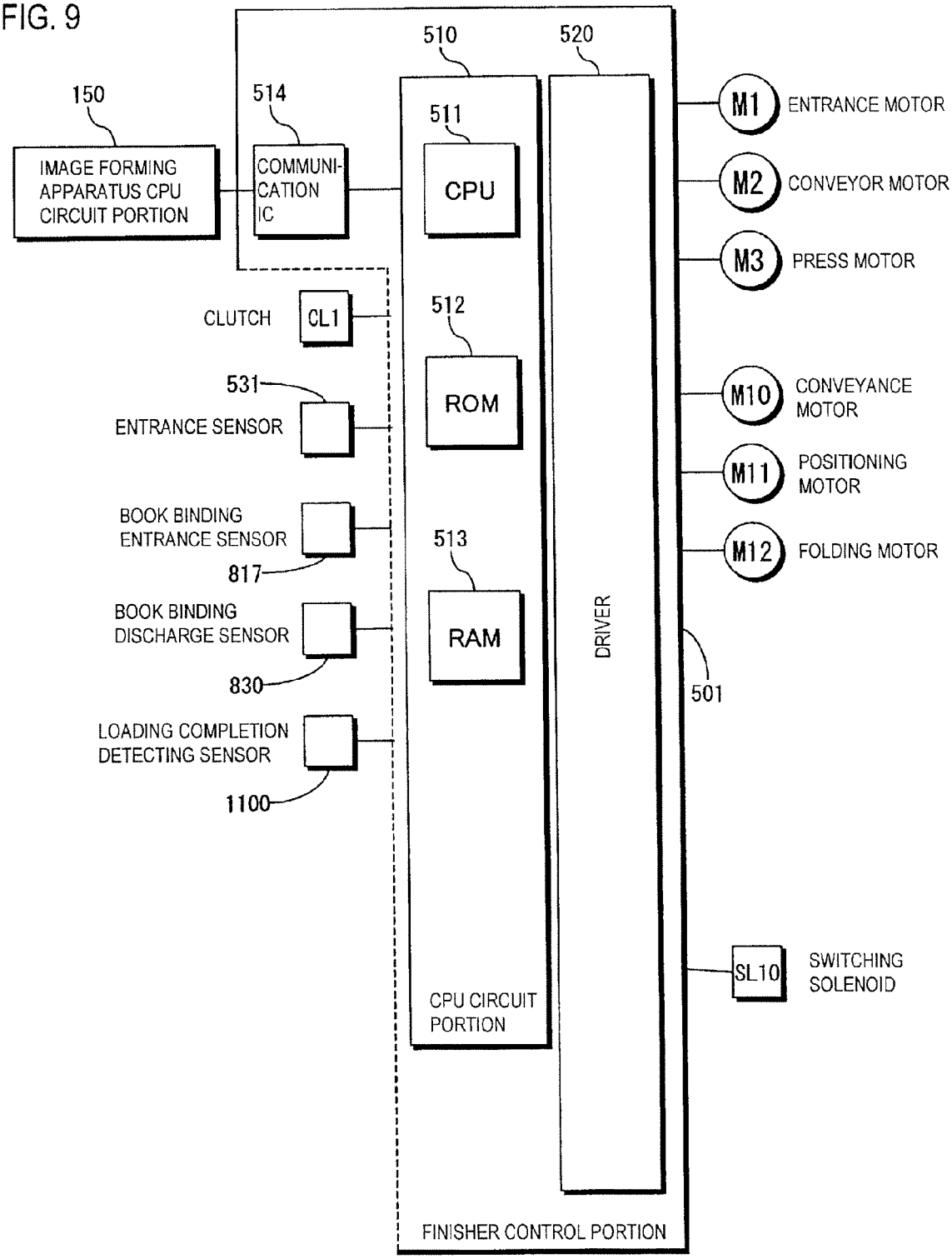
FIG. 9 is a block diagram showing the structure of a finisher control portion according to the embodiment of the present invention.

Next, the finisher control portion 501 for controlling the finisher 500 will be described. FIG. 9 shows the structure of the finisher control portion 501 shown in FIG. 8.

As shown in FIG. 9, the finisher control portion 501 includes a CPU circuit portion 510 which comprises a CPU 511 as information process portion, ROM 512, RAM 513 and the like. The CPU circuit portion 510 exchanges data by communicating with the CPU circuit portion 150 provided on the image forming apparatus main body through a communication IC 514. Further, a variety of programs stored in the ROM 512 are executed based on an instruction from the CPU circuit portion 150 so as to execute drive control on the finisher 500. In the meantime, the CPU circuit portion 510 has a jam timer (not shown) for detecting a jam.

To control the drive of the finisher 500, a detection signal is inputted to the CPU circuit portion 150 from a variety of sensors. The variety of the sensors include an entrance sensor 531, a book binding entrance sensor 817, a book binding discharge sensor 830 and a loading completion detecting sensor 1100.

As shown in FIG. 9, a driver 520 is connected to the CPU circuit portion 510. The driver 520 drives various motors, solenoid and clutch based on a signal from the CPU circuit portion 510. Although according to this embodiment, the finisher control portion 501 is provided on the finisher 500, it may be provided integrally with the CPU circuit portion 150 provided on the image forming apparatus main body.

The CPU circuit portion 150 provided on the image forming apparatus main body can control the drive of the finisher 500 directly or through the finisher control portion 501 provided on the finisher 500. However, it is more preferable to provide the finisher control portion on the finisher 500 as an option because the control portion on the image forming apparatus main body can be minimized.

As the various motors driven by the aforementioned driver 520, an entrance motor M1, conveyor motor M2 and press motor M3 are provided. The entrance motor M1 is a drive source for the pair of the entrance rollers 502, the pair of the conveyor rollers 503 and the pair of the conveyor rollers 906. The conveyor motor M2 is a motor for driving a belt for conveying the sheet bundle in the discharge tray 832. The press motor M3 is a motor for moving the press unit 1200 in a direction perpendicular to the conveyance direction.

As the various motors driven by the aforementioned driver 520, conveyance motor M10, positioning motor M11 and folding motor M12 are provided. The conveyance motor M10 is a drive source for the pair of the book binding rollers 813. The positioning motor M11 is a drive source for the sheet positioning member 823. The folding motor M12 is a drive source for the thrust member 825, the pair of the folding rollers 826 and the pair of the folding discharge rollers 827.

Of the aforementioned motors, the entrance motor M1 is composed of a stepping motor. As a result, excitation pulse rate applied to the entrance motor M1 is controlled so as to rotate the pair of the rollers driven by each motor at an equal velocity or at an independent velocity. The entrance motor M1 is so constructed to be capable of rotating in the normal direction or inverse direction by the driver 520.

The conveyor motor M2, the conveyance motor M10 and the positioning motor M11 are composed of a stepping motor. The folding motor M12 and the press motor M3 are composed of a DC motor. The conveyance motor M10 is constructed to be capable of conveying the sheet synchronously with the velocity of the entrance motor M1. The press motor M3 is constructed to be controllable in velocity. Further, as for the solenoid, the solenoid SL10 for switching the switching flapper 551 is provided.

(Book Binding Process and Image Formation Process on Book Binding Mode)

Next, the book binding process will be described. FIG. 14 shows a schematic diagram for explaining image formation process on book binding mode in the copying machine 1000 of the embodiment. This embodiment will be described about a case where the quantity of originals to be read is eight.

Figure 14A:
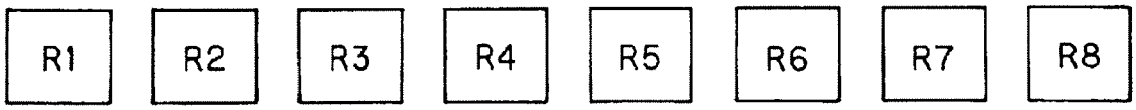
FIGS. 14A, 14B, 14B and 14C are schematic diagrams for explaining the book binding process according to the embodiment of the present invention.

When the book binding mode is specified, as shown in FIG. 14A, originals set in the tray 1001 of the original conveying portion 100 are read successively from a head page thereof. Image of a read original is stored in an auxiliary memory portion such as hard disk (not shown) in the image signal control portion 202 (see FIG. 8) successively and the quantity of read originals is counted.

When the reading process of the original is terminated, the read original images are classified according to a following equation (1). Then, the image formation order and image formation position of this original image are determined.

$$M=n\times 4-k \tag{1}$$

(M: quantity of originals, n: integer of 1 or more and quantity of sheets for use in forming an image of original, k=0, 1, 2, 3)

Figure 14B:
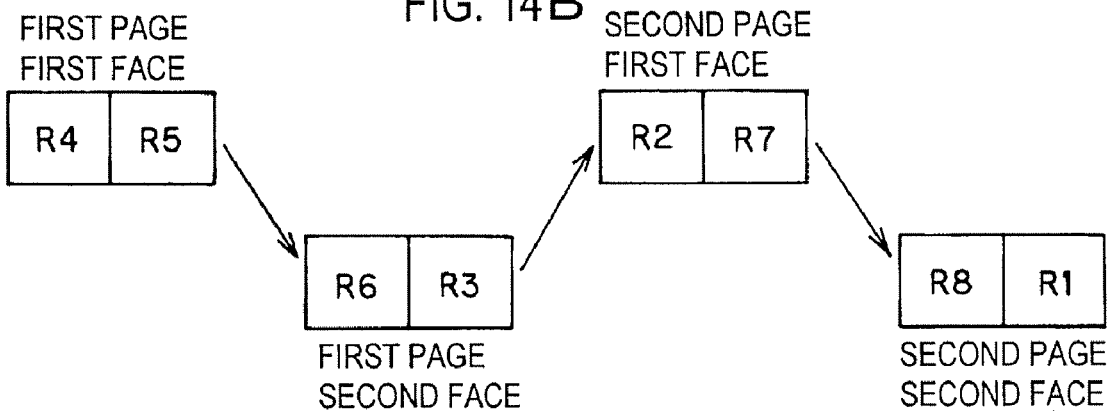

If original image data (R1, R2, R3, R4, R5, R6, R7, R8) of eight pages is stored in hard disk in the order of being read, the image formation order and image formation position are determined for each of the image data R1-R8. Consequently, as shown in FIG. 14B, an image R4 is formed on left half of a first face (front face) of the sheet P1 of a first page and an image R5 is formed on right half. The image formed on the sheet is an image after mirror image treatment.

The sheet P1 on which the image data R4, R5 are formed is fed to the transfer unit 116 (see FIG. 1) through the sheet re-feeding path 124 again. An image of image data R6 is formed on left half of a second face (rear face) of the sheet P1 and an image of image data R3 is formed on right half. The sheet P1 in which images are formed on both sides is discharged from the printer portion 300 as it is, namely with its rear face up and then conveyed to the first book binding path 553 in the finisher 500.

Figure 14C:
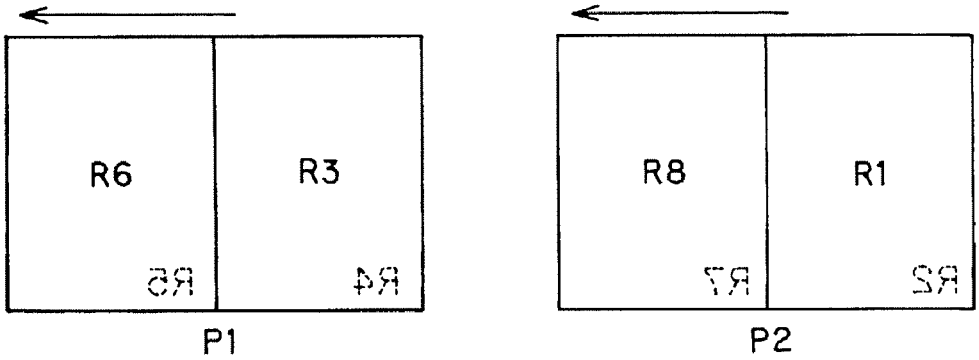

When the sheet P1 is conveyed from the printer portion 300 to the finisher 500, it is conveyed in the direction of an arrow in FIG. 14C with the second face in which an image of image data R6 and image data R3 are formed facing up and the image of the image data R6 ahead. In the meantime, an image of image data R5 is formed on the back side of the portion in which the image of the image data R6 is formed and image data R4 is formed on the back side of the portion in which the image of the image data R3 is formed.

After that, a process of the second page is carried out following the above-mentioned process. As shown in FIG. 14B, an image of image data R2 is formed on left half of a first face (front face) of this sheet P2 of the second page and an image of image data R7 is formed on right half. The image formed on the sheet is an image after mirror image treatment as described above.

The sheet P2 on which the image of image data R2 and image data R7 are formed is fed to the transfer unit 116 through the sheet re-feeding path 124 again. An image R8 is formed on left half of a second face (rear face) of this sheet P2 and an image R1 is formed on right half. The sheet P2 in which the images are formed on both faces is discharged from the printer portion 300 as it is, namely with its rear up and conveyed to the first book binding path 553 of the finisher 500.

When the sheet P2 is conveyed from the printer portion 300 to the finisher 500, it is conveyed in the direction of an arrow in FIG. 14C with the second face in which an image of image data R8 and image data R1 are formed facing up and the image of the image data R8 ahead. In the meantime, as shown in FIG. 14C, an image of image data R7 is formed on the back side of the portion in which the image of the image data R8 is formed and an image of image data R2 is formed on the back side of the portion in which the image of the image data R1 is formed.

Figure 14D:
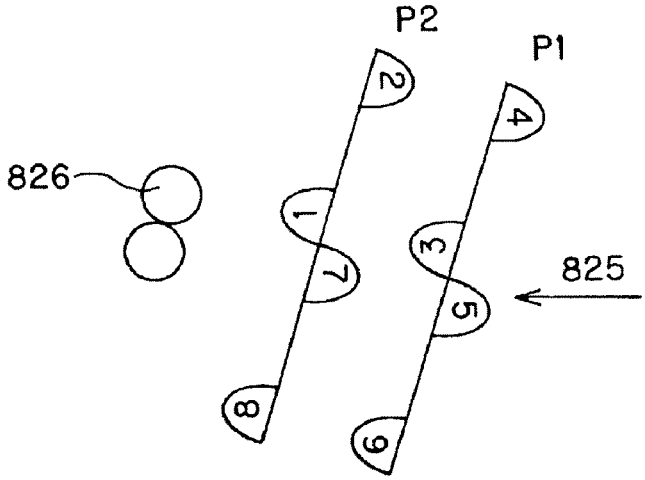

The sheets P1, P2 are introduced successively into the storage guide 820 through the first book binding path 553 of the finisher 500 shown in FIG. 2 and stored therein. As shown in FIG. 14D, the sheet P1 is stored on the thrust member 825 side within the storage guide 820 and a following sheet P2 is stored on the side of the pair of the folding rollers 826 side.

The sheets P1, P2 are stored with the first face (front face) facing to the thrust member 825. Positioning of the sheets P1, P2 within the storage guide 820 is carried out by the positioning member 823.

Figure 15A:
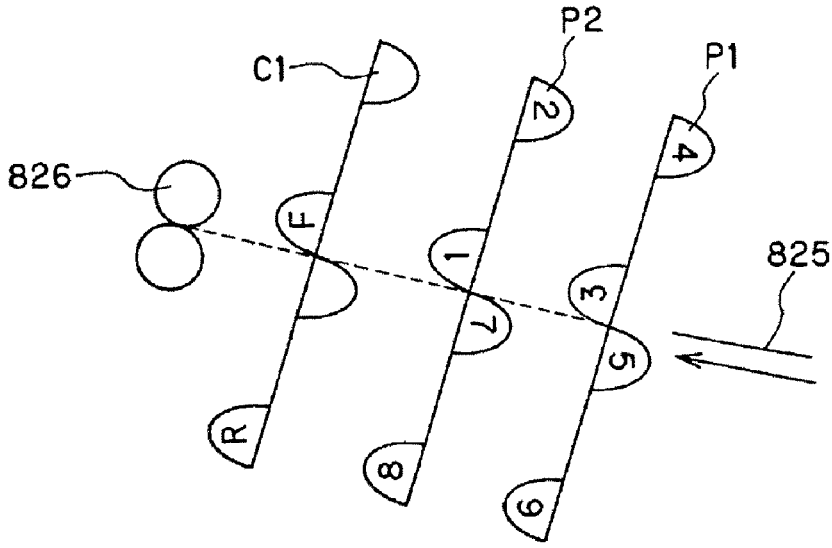
FIGS. 15A and 15B are schematic diagrams for explaining the book binding process according to the embodiment of the present invention.

After the plurality of sheets P1, P2, . . . are stored in the storage guide 820, the thrust member 825 is thrust against this sheet bundle as shown in FIG. 15A. Consequently, the sheet bundle is pushed toward the pair of the folding rollers 826. The sheet bundle pushed to the pair of the folding rollers 826 is folded along the center portion (image border line of image face) by the pair of the folding rollers 826 and discharged to the saddle discharge tray 832.

Figure 15B:
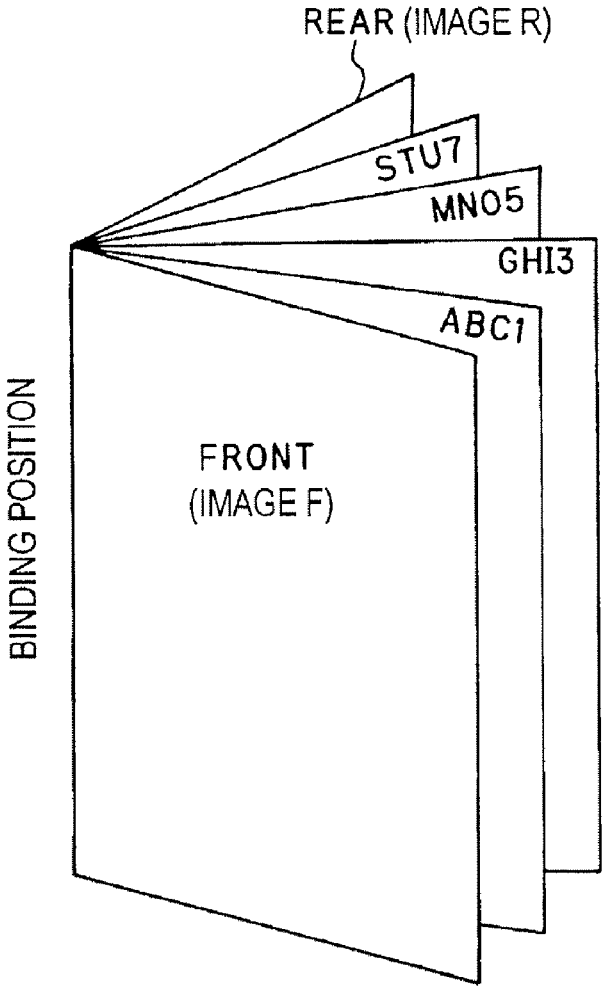
Figure 16:
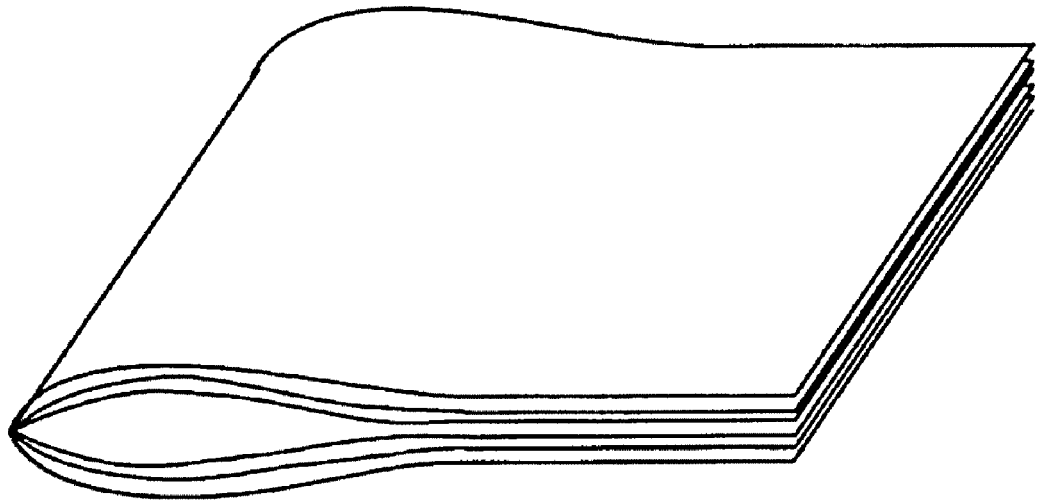
FIG. 16 is a schematic diagram showing a swelling of a folded portion of a sheet bundle.
Figure 17:
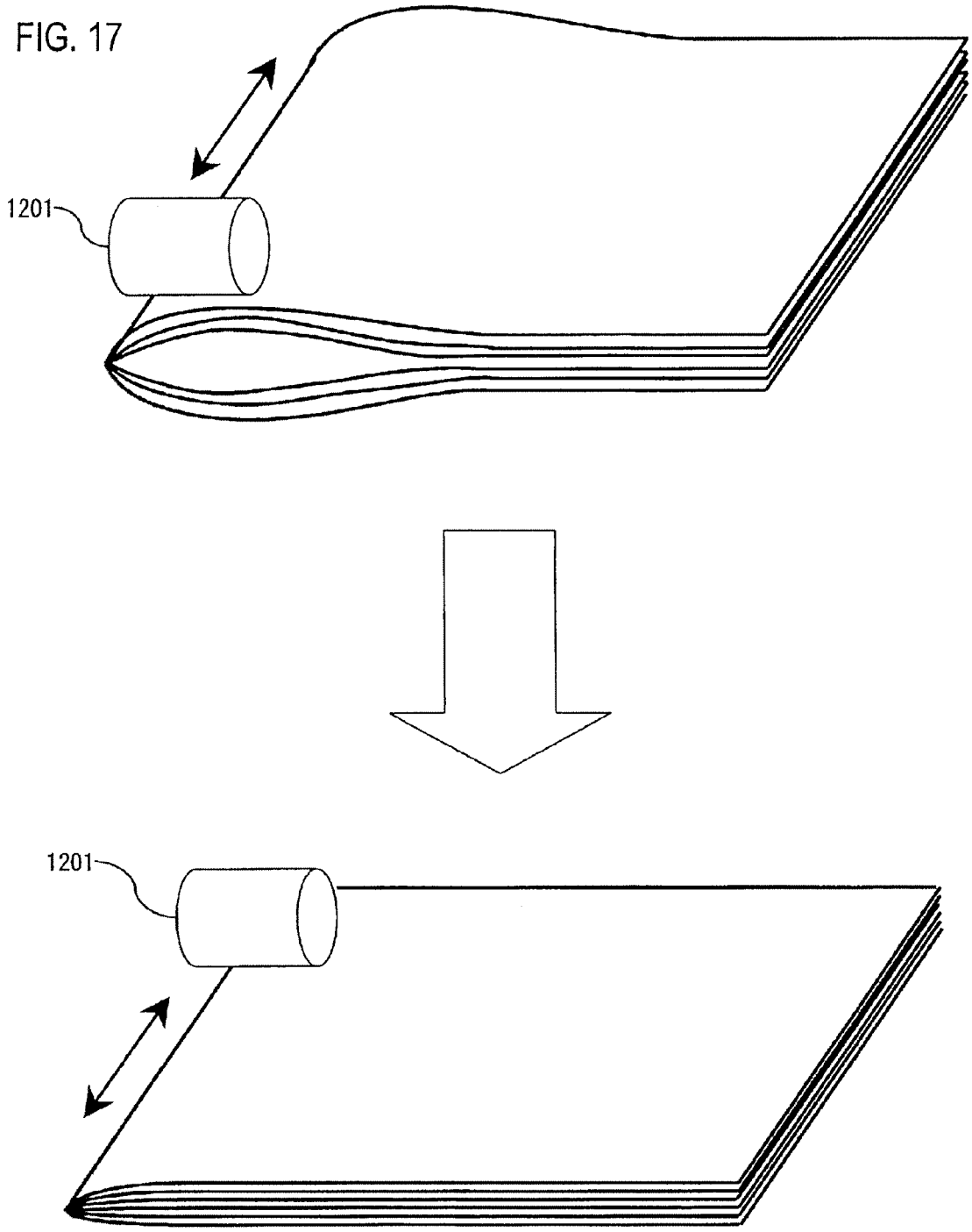
FIG. 17 is a schematic diagram showing a process of pressing the folded portion.
Figure 18A:
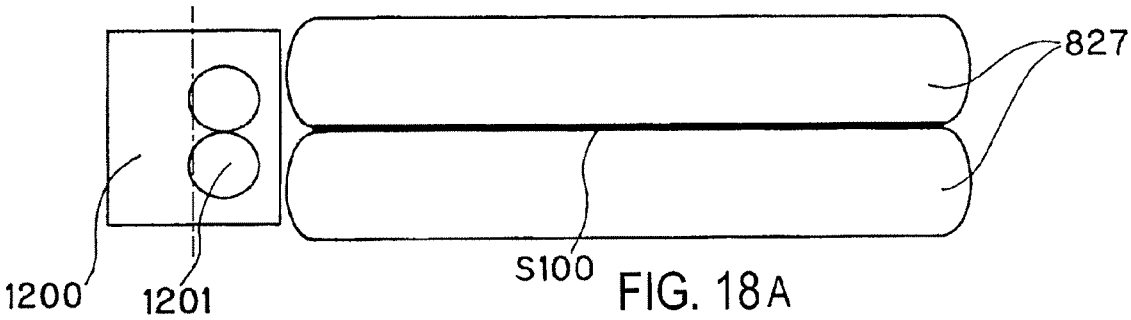
FIGS. 18A, 18B and 18C are schematic diagrams for explaining related art.
Figure 18B:
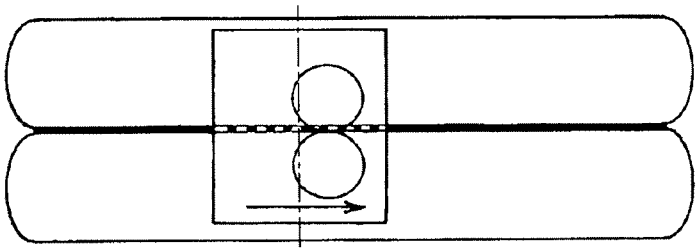
Figure 18C:
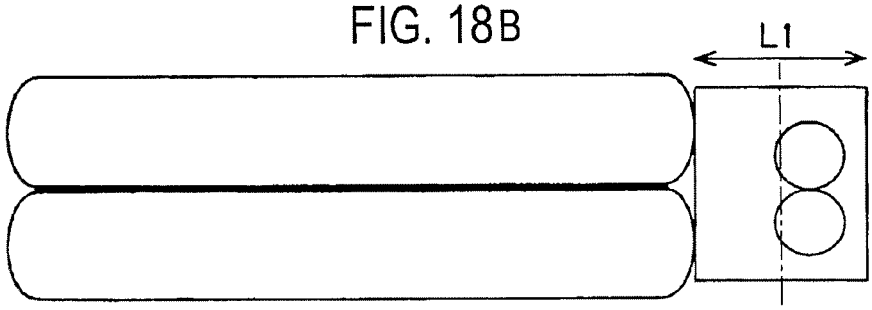

In the sheet bundle folded in this way, as shown in FIG. 15B, images on the sheets P1, P2, . . . are disposed in the order of page. Consequently, the directions of respective images on the sheets P1, P2, coincide.

(Finisher Drive Control)

Figure 10:
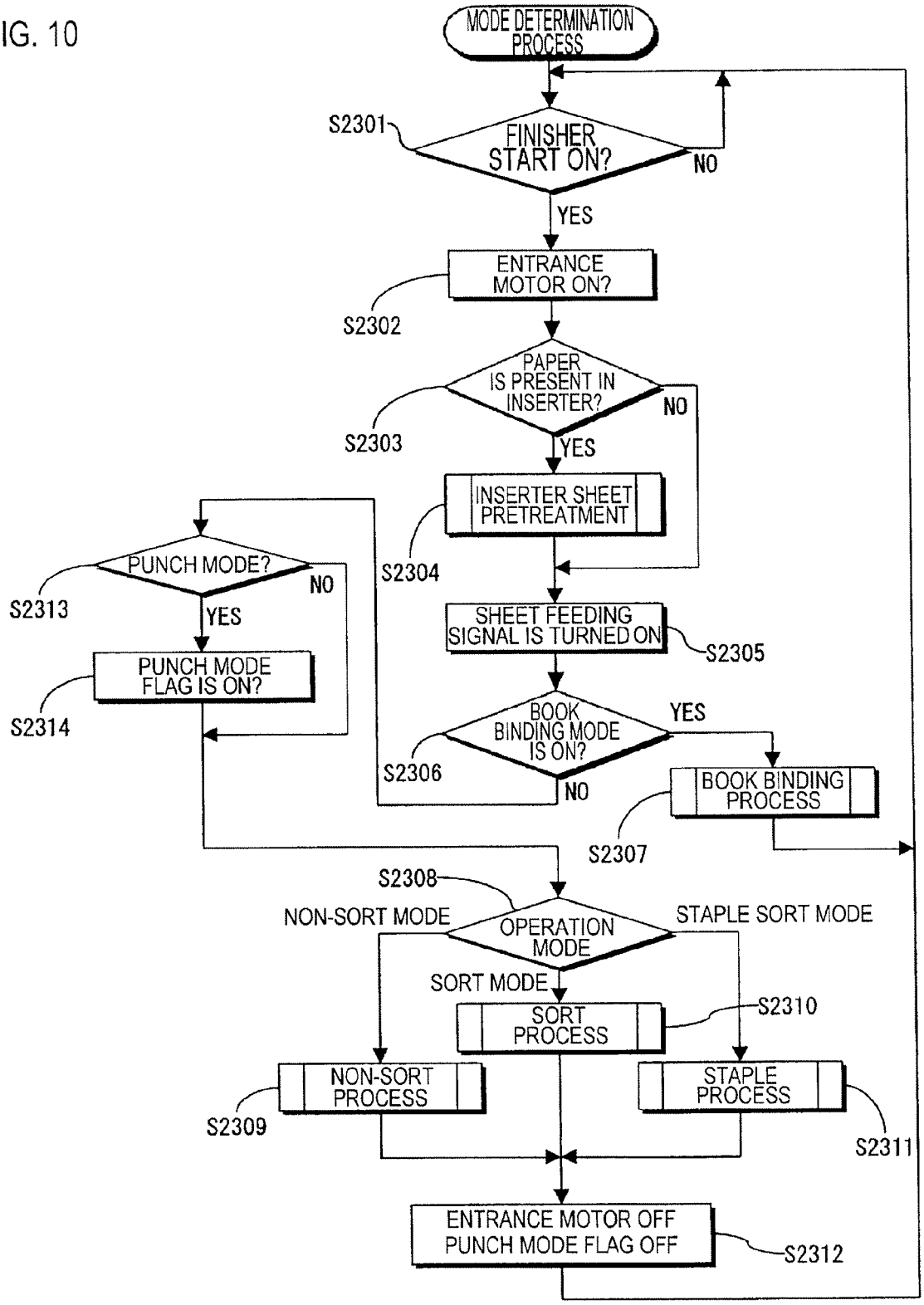
FIG. 10 is a flow chart showing an operation mode determination process in the sheet processing apparatus according to the embodiment of the present invention.

Next, a process on drive control of the finisher 500 will be described. FIG. 10 shows a flow chart of determination process on operation mode to the finisher 500. In the meantime, the drive control process of this embodiment is executed by the CPU circuit portion 510 within the finisher control portion 501 based on a signal supplied from the CPU circuit portion 150.

In step S2301, as shown in FIG. 10, whether or not a finisher start signal which instructs the finisher 500 to start the operation is inputted to the finisher control portion 501 is determined. This step S2301 is repeated until the finisher start signal is inputted to the finisher control portion 501 from the CPU circuit portion 150 when the start key of the operation panel 1 is pressed by the user to instruct starting of copying.

If it is determined that the finisher start signal is inputted to the finisher control portion 501 in step S2301 (S2301: YES), the procedure proceeds to step S2302, in which the entrance motor M1 is started.

Next, the procedure proceeds to step S2303, in which whether or not a request for feeding the sheet to the inserter 900 arises is determined based on data from the communication IC 514 shown in FIG. 9. The request for feeding the sheet to the inserter 900 is sent to the finisher control portion 501 if the inserter is selected by the user.

If it is determined that the request for feeding the sheet to the inserter 900 arises in step S2303 (S2303: YES), the procedure proceeds to step S2304, in which inserter sheet feeding pretreatment is executed. After that, the procedure proceeds to step S2305. On the other hand, if it is determined that no request for feeding sheet to the inserter 900 arises in step S2303 (S2303: NO), the procedure proceeds to step S2305 without proceeding to step S2304.

In step S2305, a sheet feeding signal is supplied to the CPU circuit portion 150 of the copying machine 1000 through the communication IC 514. The CPU circuit portion 150 supplied with this sheet feeding signal starts the image formation process.

Next, the procedure proceeds to step S2306, in which whether or not the operation mode set by the operation panel 1 is book binding mode is determined based on post processing mode data supplied from the CPU circuit portion 150 through the communication IC 514. If it is determined that the set operation mode is book binding mode in step S2306, the procedure proceeds to step S2307, in which book binding process is executed. The detail of the book binding process in step S2307 will be described later. After the book binding process in step S2307 is completed, the procedure returns to step S2301.

On the other hand, if it is determined that the set operation mode is not book binding mode in step S2306 (S2306: NO), the procedure proceeds to step S2313.

Whether or not punch mode is set by the user is determined in step S2313. If the punch mode is set (S2313: YES), the procedure proceeds to step S2314. Then, after punch mode flag is turned ON in step S2314, the procedure proceeds to step S2308. On the other hand, if it is determined that no punch mode is set in step S2313 (S2313: NO), the procedure proceeds to step S2308 without executing the process of step S2314.

In step S2308, which mode is the set operation mode of non-sort mode, sort mode and staple sort mode is determined. If it is determined that the set operation mode is non-sort mode in step S2308, the procedure proceeds to step S2309, in which the non-sort process is executed. If it is determined that the set operation mode is sort mode in step S2308, the procedure proceeds to step S2310, in which the sort process is executed. If it is determined that the set operation mode is staple sort mode in step S2308, the procedure proceeds to step S2311, in which the staple sort process is executed.

If the non-sort process in step S2309, the sort process in step S2310 or the staple sort process in step S2311 are completed, the procedure proceeds to step S2312, in which the drive of the entrance motor M1 is stopped. At the same time, if the punch mode flag is turned ON in step S2314, the punch mode flag is turned OFF. After that, the procedure returns to step S2301, in which the finisher stands by for an input of the finisher start signal.

If any process of steps S2307, S2309, S2310 and S2311 is carried out and it is determined that a request for feeding the sheet to the inserter 900 arises in step S2303, first, the inserter paper feeding pretreatment of step S2304 is executed.

(Book Binding Process)

Figure 11:
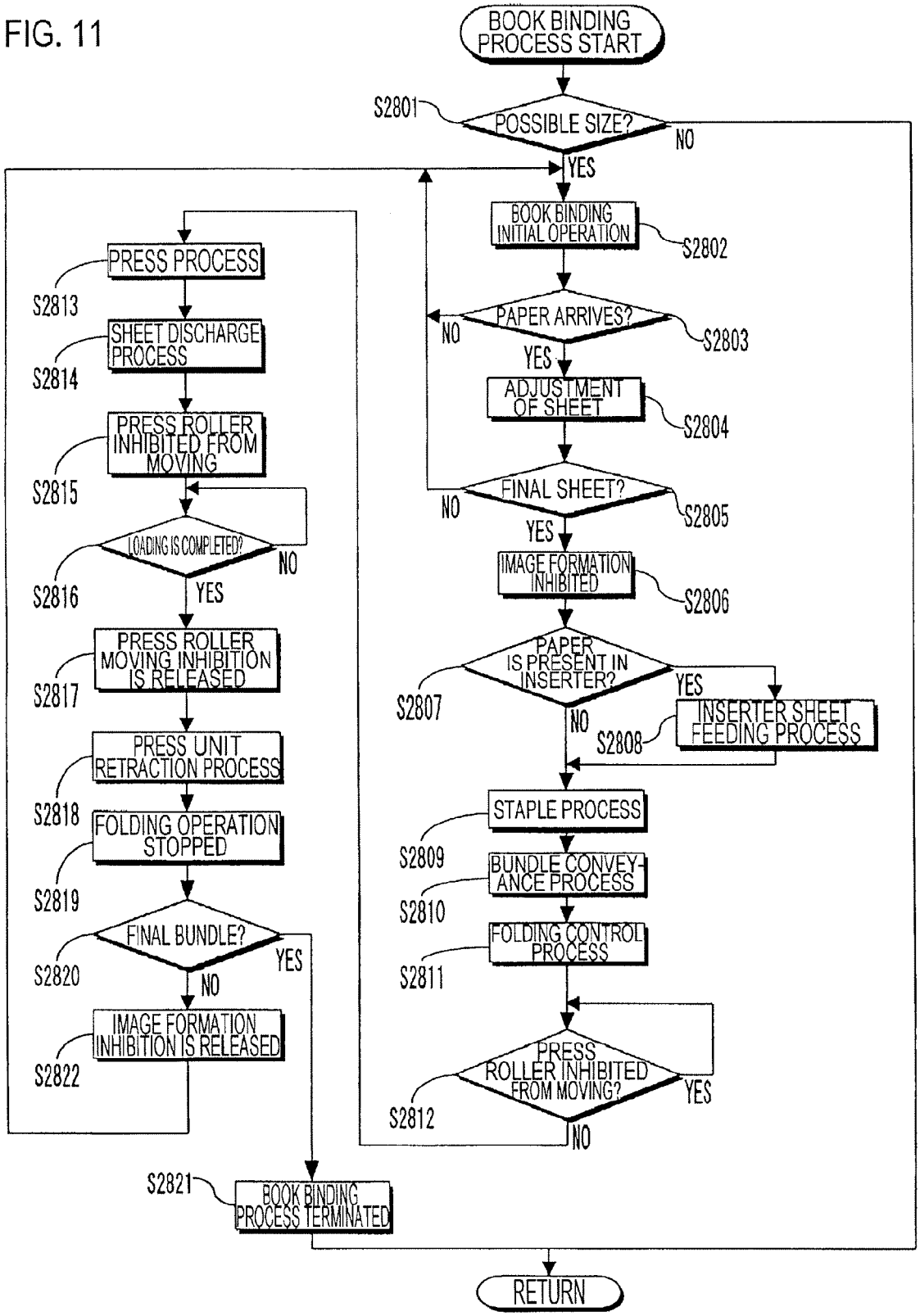
FIG. 11 is a flow chart showing a book binding process in the sheet processing apparatus according to the embodiment of the present invention.

Next, the above-described book binding process on book binding mode according to the embodiment of the present invention will be described. FIG. 11 shows a flow chart of the book binding process of the embodiment. In the meantime, this process is a process executed when it is determined that the operation mode is book binding mode in step S2306 of FIG. 10.

In the book binding process of the embodiment, whether or not the size of a sheet conveyed from the printer portion 300 to the finisher 500 is a size appropriate for book binding is determined based on size information in step S2801. If it is determined that the size of the sheet is not appropriate for the book binding in step S2801, this process is terminated and the procedure returns to step S2301 shown in FIG. 10.

On the other hand, if it is determined that the size of the sheet is a size appropriate for book binding in step S2801 (S2801: YES), the procedure proceeds to step S2802, in which the initial operation of the book binding is executed.

In the initial operation of book binding in step S2802, the conveyance motor M10 is driven to rotate the pair of the book binding rollers 813 to enable conveyance of the sheet. At the same time, the switching solenoid SL10 is driven to switch the switching flapper 551 to the side of the first book binding path 553 side. The sheet from the printer portion 300 is introduced to the storage guide 820. A sideways shifting member (not shown) is positioned into a width having a predetermined amount of allowance to the width of the sheet. At the same time the positioning motor M11 is rotated only by a predetermined number of steps so that a distance from the sheet positioning member 823 to a staple position of the stapler 818 is ½ the length in the sheet conveyance direction.

Next, when the procedure proceeds to step S2803, whether or not a sheet from the printer portion 300 is conveyed into the storage guide 820 is determined according to a signal from the book binding entrance sensor 817. As a result, if no sheet is conveyed into the storage guide 820, the procedure returns to step S2802.

On the other hand, if it is determined that the sheet from the printer portion 300 is conveyed into the storage guide 820 (S2803: YES) in step s2803, the procedure proceeds to step S2804. In step S2804, the sideways shifting member (not shown) is actuated after a predetermined time elapses. As a consequence, adjustment of the sheet stored in the storage guide 820 in the width direction is executed.

After that, whether or not a sheet processed in step S2804 is a final one of sheets which should be processed as a bundle is determined in step S2805. If this sheet is not the final one, the procedure returns to step S2802.

On the other hand, if it is determined that this sheet is the final one in step S2805 (S2805: YES), the procedure proceeds to step S2806. An image formation inhibit signal is outputted to the CPU circuit portion 150 to prevent any sheet from being conveyed from the printer portion 300 to the finisher 500 in step s2806.

Next, the procedure proceeds to step S2807, in which whether or not feeding of the sheet from the inserter 900 is instructed by the user is determined. If it is determined that feeding of the sheet from the inserter 900 is instructed (S2807: YES), the procedure proceeds to step S2808. After the process of feeding the sheet from the inserter is executed in step S2808, the procedure proceeds to step S2809. On the other hand, if it is determined that feeding of the sheet from the inserter 900 is not instructed in step S2807 (S2807: NO), the procedure proceeds to step S2809.

In step S2809, stapling process is executed on a sheet bundle arranged in the storage guide 820 using the stapler 818 (see FIG. 2). After that, the procedure proceeds to step S2810, in which a bundle conveyance process (a bundle movement process) is executed. In the bundle conveyance process of step S2810, the sheet bundle is conveyed by a distance between a staple position of the stapler 818 and a nipping position of the pair of the rollers 826. For this conveyance, the positioning motor M11 is driven to lower the sheet positioning member 823 and the conveyance motor M10 is driven again to rotate the pair of the book binding rollers 813.

After the process of step S2810 is executed, the procedure proceeds to step S2811, in which the folding control process is executed. In the folding control process of step S2811, the clutch CL1 is driven and the folding motor M12 is driven so as to move the thrust member 825 toward the pair of the folding rollers 826 (direction of an arrow in FIG. 15A).

The center of the sheet bundle S100, namely, the staple position on the sheet is guided to the nipping point of the pair of the folding rollers 826 by the folding control process and the sheet is folded in half by the pair of the folding rollers 826. In the meantime, the thrust member 825 is so constructed to be capable of reciprocating by means of a cam mechanism and when it is detected that this thrust member 825 has reciprocated by a lap by a sensor (not shown), the drive of the clutch CL1 is stopped.

After the folding control process of step 82811 is executed, the procedure proceeds to step S2812, in which whether or not the press rollers are inhibited from moving is determined. Inhibition of the pair of the press rollers 1201 from moving in step S2812 is executed to inhibit the pair of the press rollers 1201 from moving during discharge of the sheet bundle into a loading tray. In the meantime, inhibition of the pair of the press rollers 1201 from moving is set in step 2815 described later.

If the press rollers are inhibited from moving (S2812: YES), the system stands by until inhibition of the pair of the press rollers 1201 from moving is released. According to this embodiment, the book binding sequence is started for each sheet and the sequences are executed in parallel. That is, the determination process of step S2812 is a process of determining whether or not inhibition of the press rollers from moving set during discharge of the sheet bundle in advance is released.

Unless the press rollers are inhibited from moving (S2812: NO), the procedure proceeds to step S2813, in which the press process for crushing the folded portion of the sheet bundle is executed by moving the pair of the press rollers 1201 in a direction perpendicular to the conveyance direction.

The moving speed of the pair of the press rollers 1201 when moved for the press process is changed depending on the quantity of sheet bundles so as to ensure an excellent folding line as shown in FIG. 13. Although the moving speed of the pair of the press rollers 1201 is changed depending on the quantity of the sheet bundle in this embodiment, it may be changed depending on the rigidity of the sheet or sheet size.

Next, the procedure proceeds to step S2814 shown in FIG. 11, in which discharge process of discharging the sheet bundle into the loading tray is executed. Subsequently, the procedure proceeds to step S2815, in which the inhibition of the press rollers from moving is set up. That is, the system stands by for moving of the pair of the press rollers 1201. Then, the procedure proceeds to step S2816.

Whether or not loading of the sheet bundle is terminated is determined in step S2816. According to this embodiment, loading of the sheet bundle is terminated when it is detected that the rear end of the sheet bundle passes the loading completion detecting sensor 1100. As a detection method for termination of loading of the sheet bundle, a method of detecting a feeding amount of the pair of the discharge rollers 827 after the sheet bundle is discharged and a method of determination with a time elapsing since the start of discharge of the sheet bundle are available as well as the method adopted by this embodiment.

If it is determined that the termination of the loading of the sheet bundle is detected in step S2816 (S2816: YES), the procedure proceeds to step S2817, in which the inhibition of the pair of the press rollers 1201 from moving is released.

After that, the procedure proceeds to step S2818, in which press roller retraction process is executed. The press roller retraction process is a process of moving the pair of the press rollers 1201 to a press roller moving start position for a next sheet bundle.

In the press roller retraction process, the sheet is absent and load is small and the height of the folded portion makes no influence as shown in FIG. 13. Thus, the press roller moving speed is set faster than the moving speed of the press process. As a result, the processing time is reduced.

Next, the procedure proceeds to step S2819 in FIG. 11, in which the drive of the folding motor M12 is stopped. After that, whether or not this sheet bundle is a final sheet bundle for book binding process is determined in step S2820.

If it is determined that it is the final sheet bundle for the book binding process in step S2820 (S2820: YES), the procedure proceeds to step S2821, in which the termination process of the book binding mode is executed.

In the termination process of the book binding mode in step S2821, the aforementioned sideways shifting member and the sheet positioning member 823 are moved to each predetermined standby position. The switching flapper 551 is switched to the side of the finisher path 552 side, and the book binding mode is terminated. After the process of step S2815 is executed, the procedure returns to step S2301 in the flow chart shown in FIG. 10.

On the other hand, if it is determined that it is not the final sheet bundle for the book binding process in step S2820 (S2820: NO), the procedure proceeds to step S2822. In step S2822, the image formation inhibit signal is released and the procedure returns to step S2802 after the release signal is supplied to the CPU circuit portion 150. The book binding process of this embodiment is terminated.

According to this embodiment, the loading completion detecting sensor 1100 for detecting discharge of the sheet bundle S100, that is, completion of the loading is provided and a contact between the sheet bundle S100 and the pair of the press rollers 1201 is prevented by moving the pair of the press rollers 1201 after the sheet bundle S100 is discharged completely so as to maintain the loading on the discharge tray 832 in an excellent condition.

(Operation of Press Unit)

Next, the operation of the press unit 1200 for each sheet size will be described. FIG. 5 shows the operation of the press unit when pressing a sheet of large size like A3.

Figure 5A:
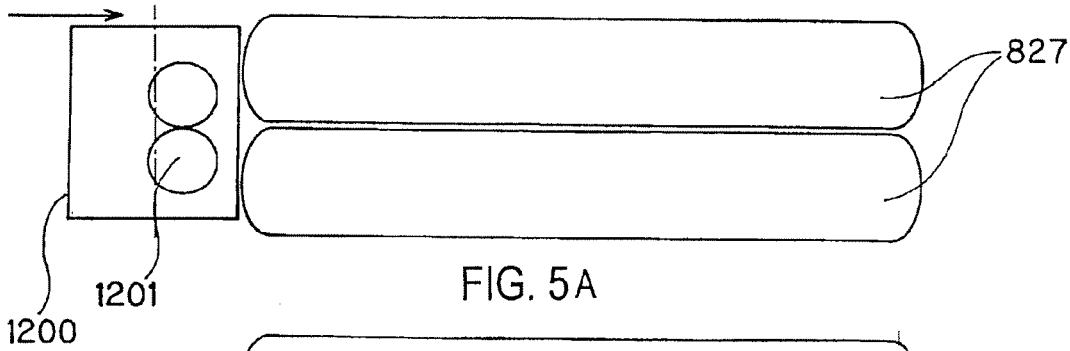
FIGS. 5A, 5B, 5C, 5D and 5E are schematic diagrams showing the press operation on the sheet bundle (large width size) of the embodiment of the present invention.
Figure 5B:
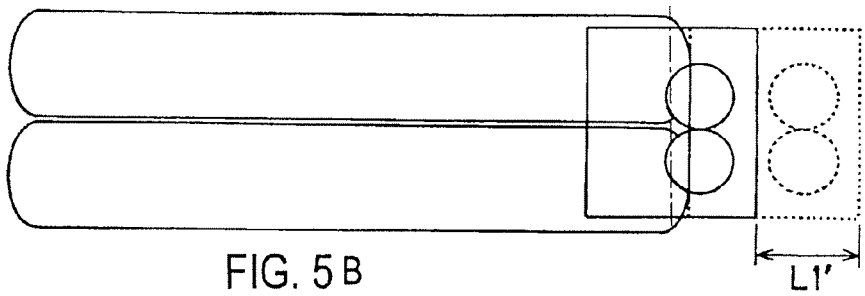

If the sheet size is of large size like A3 as shown in FIG. 5A, the press unit 1200 moves from a rear face standby position for start of copying operation to the right side (front face side of the apparatus). The press unit 1200 moves up to a sheet receiving position on the front side of the apparatus set previously depending on the sheet size as shown in FIG. 5B. The sheet receiving position is set according to the sheet size at a position in which the nipping portion 1201*n* of the pair of the press rollers 1201 does not interfere with an end S100*a* in a direction perpendicular to the conveyance direction of the sheet bundle S100 to be conveyed. This position is a position where when the pair of the press rollers 1201 is moved to start the pressing process, the folded portion of the sheet bundle S100 is caught by the nipping portion 1201*n* immediately. That is, this is a position corresponding to a stop position of the folded portion of the sheet bundle S100 in the conveyance direction of the sheet bundle S100, which is as near an end S100*a* of the sheet bundle S100 as possible in the direction perpendicular to the conveyance direction of the sheet bundle S100. This sheet receiving position is set considering a shift of the end S100*a* of the sheet bundle conveyed as shown in FIG. 5C in the direction perpendicular to the conveyance direction.

Figure 5C:
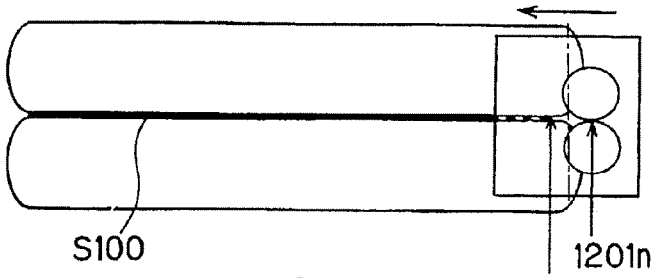
Figure 5D:
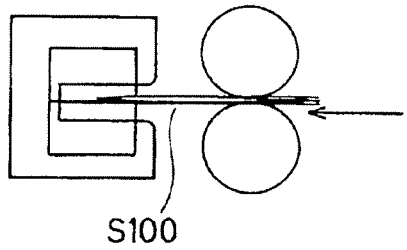
Figure 5E:
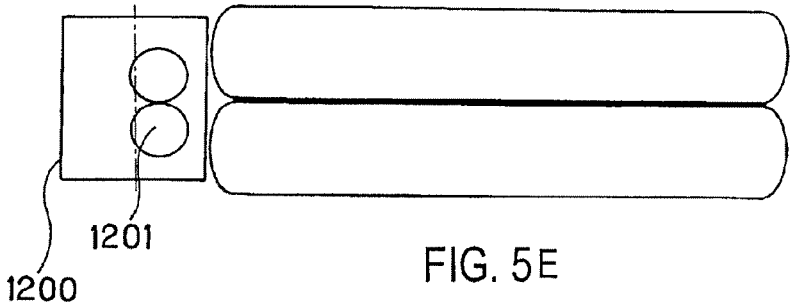

After that, the sheet bundle S100 invades into the press unit 1200 as shown in FIGS. 5C, 5D. When the front end of the sheet bundle S100 reaches a moving area of the pair of the press rollers 1201 as shown in FIG. 5D, the pair of the discharge rollers 827 is stopped. Subsequently, the folded portion of the sheet bundle S100 is pressed at the nipping portion 1201*n* of the pair of the press rollers 1201 and moved to the rear side of the apparatus as shown in FIG. 5E.

Although the press unit 1200 can be stopped with the front end of the sheet bundle S100 invading into the press unit 1200 at the sheet receiving position, the sheet bundle S100 cannot be discharged into the discharge tray 832 at this position. Thus, when large size sheet bundles are executed the pressing process continuously, the press unit 1200 moves in a single direction from the sheet receiving position to the standby position on the rear side of the apparatus so as to press the folded portion because it needs to always wait for discharge of the sheet bundle S100 at the rear face standby position. This rear face standby position is a sheet bundle discharge enable position. The sheet bundle discharge enable position is a position where the sheet bundle S100 is discharged without any interference with the press unit 1200. By setting the standby position (sheet bundle discharge enable position) on only the rear side of the apparatus, the width of the apparatus can be reduced as much as an interval L1' shown in FIG. 5B on the front side of the apparatus.

Figure 6C:
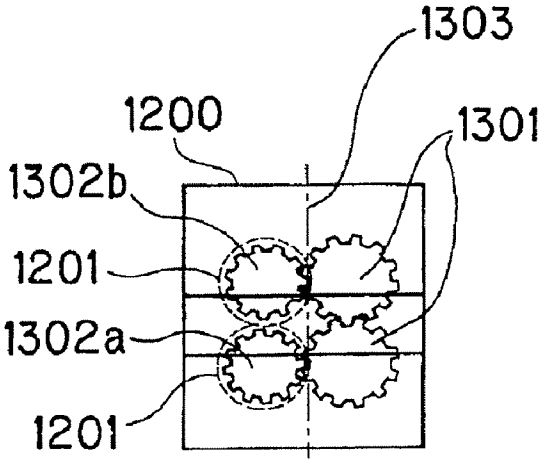
FIGS. 6A, 6B, and 6C are schematic diagrams for explaining the inside of the press unit of the embodiment of the present invention.
Figure 6B:
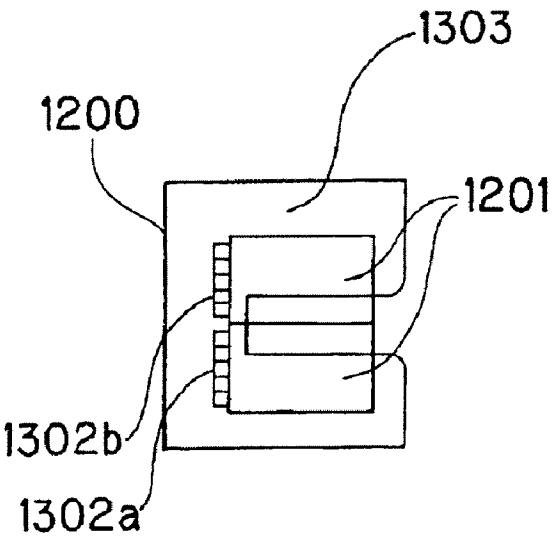
Figure 6A:
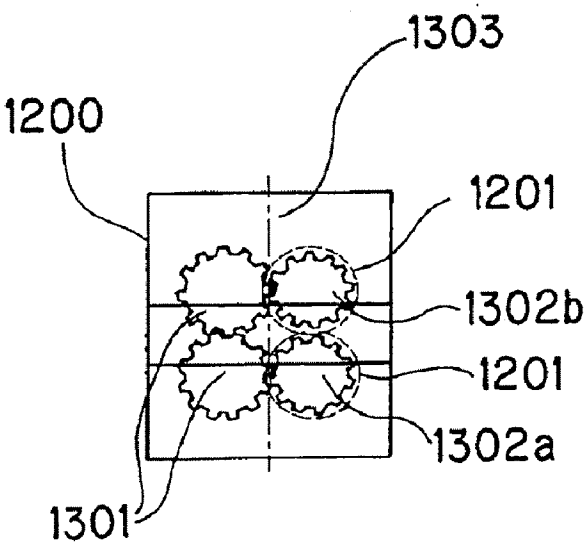

FIG. 6 shows the detail of the press unit 1200. FIGS. 6A, 6B, 6C are transparent views of the press unit 1200 as seen from back, sideways, and forward respectively.

As shown in FIG. 6, the press unit 1200 has gears 1302*a*, 1302*b* which receive a drive force integrally with the pair of the press rollers 1201. A pair of gears 1301 for applying a drive force to the gears 1302*a*, 1302*b* are provided adjacent to the gears 1302*a*, 1302*b*. Then, the pair of the press rollers 1201, the gears 1302*a*, 1302*b* and the pair of the gears 1301 are covered with a housing 1303 so as to constitute the press unit 1200. Because the gears 1302*a*, 1302*b* and the pair of the gears 1301 are axially supported by the housing 1303, the pair of the press rollers 1201 provided coaxially with the gears 1302*a*, 1302*b* are disposed at a position offset to one way from the center of the housing with respect to the housing 1303. Thus, the aforementioned sheet bundle discharge enable position is determined by the relation between an end portion of the housing 1303 and an end portion of the sheet bundle S100 in a direction perpendicular to the conveyance direction of the sheet bundle S100. If the standby position (sheet bundle discharge enable position) is provided on each side of the front side and rear side of the apparatus, the respective standby positions of the pair of the press rollers 1201 are asymmetrical with respect to the center of conveyance of the sheet. If the standby position is provided on only any one of the front side and the rear side of the apparatus, the amount of motion up to the standby position of the pair of the press rollers 1201 is decreased by setting the pair of the press rollers 1201 to a side near an end portion of the sheet bundle in an offset condition, thereby reducing the processing time.

The pair of the press rollers 1201 of the press unit 1200 is disposed such that it is biased to one side with respect to the center of the press unit 1200 as shown in FIGS. 5B, 5C. As a result, a portion protruded to the front side of the apparatus (right side in FIG. 5) of the press unit 1200 is minimized. Although according to this embodiment, the standby position (sheet bundle discharge enable position) is provided on the rear side of the apparatus in order to reduce the width of the apparatus on the front side of the apparatus, it is permissible to provide the standby position on the front side to reduce the width of the apparatus on the rear side thereby finally reducing the entire width of the apparatus.

Next, a case of pressing a sheet bundle of small size like A4 will be described. FIG. 7 shows the pair of the discharge rollers 827 and the press unit 1200 when the sheet bundle of small size is pressed.

Figure 7A:
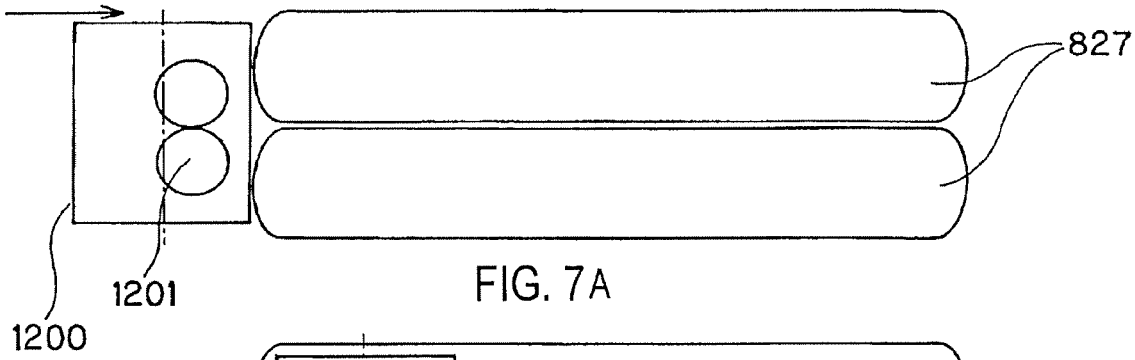
FIGS. 7A, 7B, 7C and 7D are diagrams for explaining the press operation on a sheet bundle (small width size) of the embodiment of the present invention.
Figure 7B:
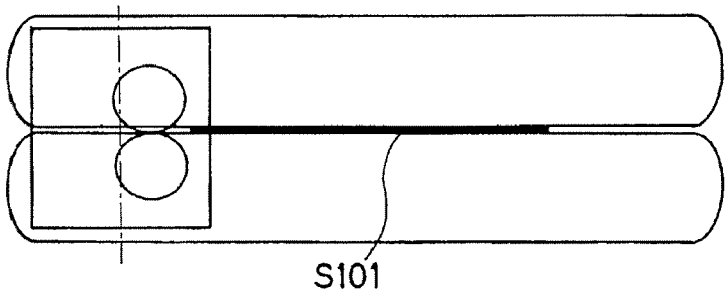

First, as shown in FIG. 7A, the press unit 1200 is located at the standby position on the rear side of the apparatus. After that, when the sheet bundle is conveyed, the press unit 1200 is moved up to a sheet receiving position of the sheet bundle S101 as shown in FIG. 7B. After that, the press unit 1200 moves toward the front side of the apparatus (right side in FIG. 7) while pressing the sheet bundle S101 with the sheet bundle S101 received by the pair of the press rollers 1201.

Figure 7C:
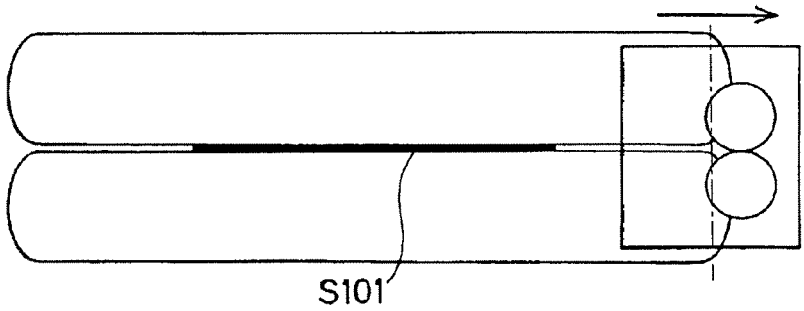
Figure 7D:
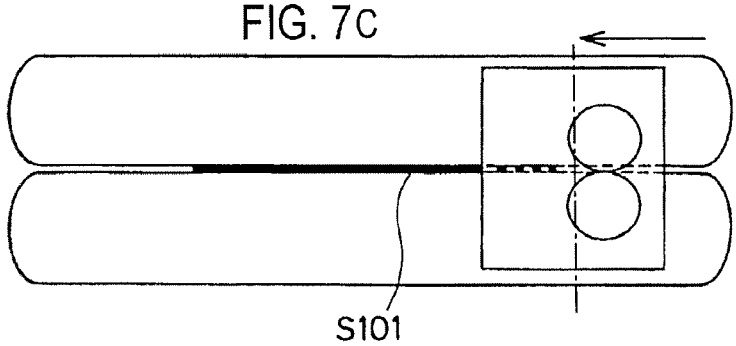

If the sheet bundle S101 to be pressurized is a small sheet of for example A4 size as shown in FIG. 7C, the sheet bundle S101 can be discharged into the discharge tray 832 not only when the press unit 1200 is located at the rear face standby position but also when it is moved most to the front side. According to this embodiment, a position on the inner side by an interval L' as shown in FIG. 5B is a standby position (sheet bundle discharge enable position) for the small size because no standby position (sheet bundle discharge enable position) is set for the large size on the front side of the apparatus. If the sheet bundle discharged next is of the same small size as the sheet bundle discharged in advance, reception of the sheet bundle is completed only when the press unit 1200 moves from a position shown in FIG. 7C to a position shown in FIG. 7D.

That is, for the sheet bundle of small size, the press process of pressing the fold line can be carried out by exchanging the sheet receiving position of the press unit 1200 between the rear side and the front side of the apparatus each time when each sheet bundle is conveyed. Further, the standby position can be provided outside in the width direction without increasing the width of the apparatus because each sheet receiving position is set to meet the small size. Thus, discharge of the sheet bundle after the process is enabled at each standby position (sheet bundle discharge enable position) on the rear side and front side of the press unit 1200. In case of a small size sheet bundle, its processing time is reduced largely as compared to a case of a large size sheet bundle.

According to this embodiment of the invention, as described above, the size of the apparatus can be reduced by changing over the home position (HP) of the press unit depending on the sheet size so as to reduce the width of the apparatus. In the meantime, US2004/0070133 has described control on the speed of the folding rollers when the pressurizing action termination point of a former sheet is adopted as the pressurizing action start point of a next sheet (home position) and the rollers start the pressurizing action from a home position located on an opposite side to the aforementioned home position. However, this patent document has described nothing about switching of the home position corresponding to the sheet size as proposed by the embodiment of the present invention.

(Control of Press Unit)

Figure 12:
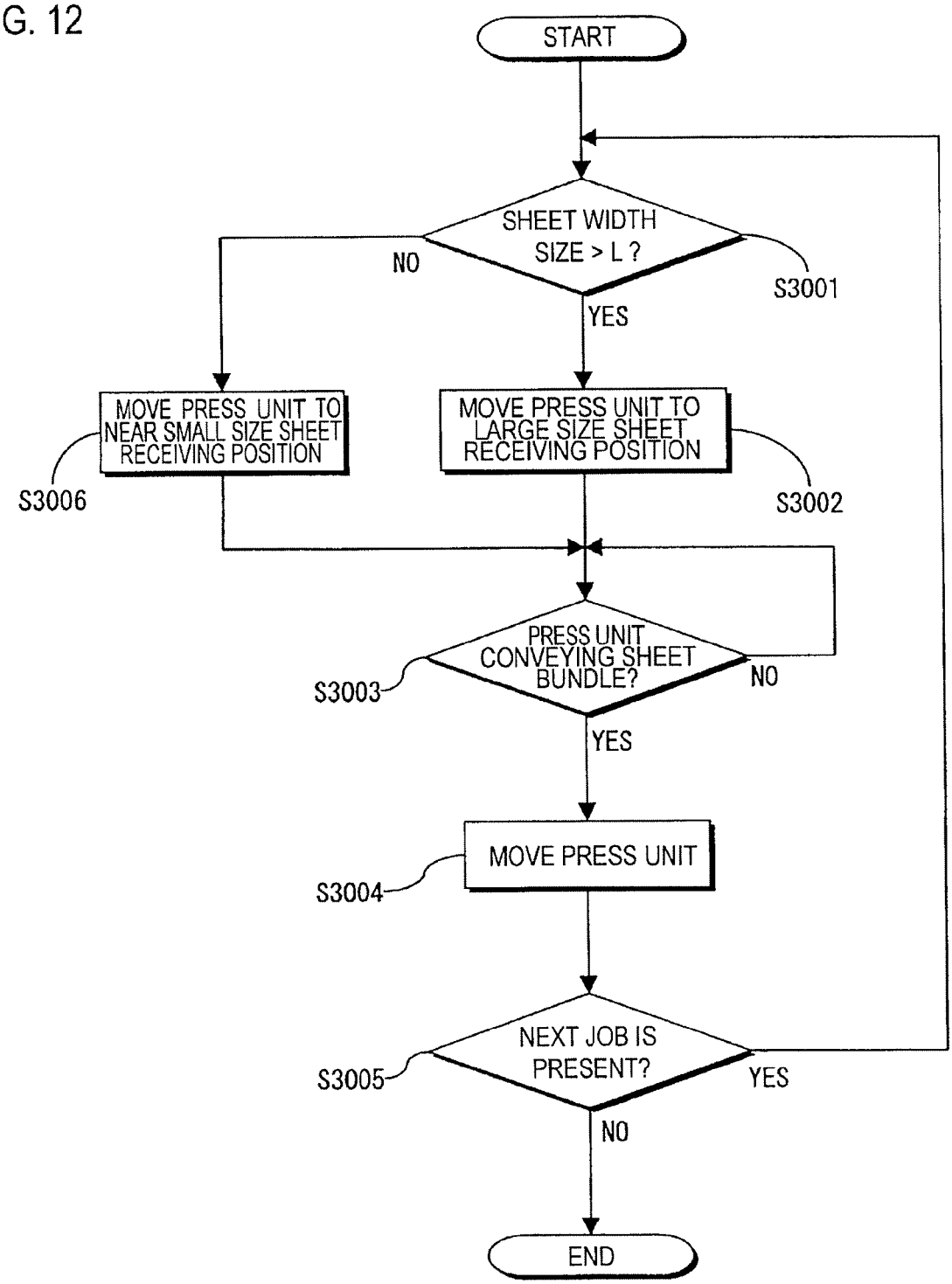
FIG. 12 is a flow chart for explaining the control of the press unit.

Next, the control of the press unit 1200 will be described. FIG. 12 is a control flow chart of the press unit 1200 of this embodiment.

If the book binding function is selected by the CPU circuit portion 150 in the book binding process of step S2307 of FIG. 10, control of the press unit shown in FIG. 12 is started.

First in step S3001, whether or not the sheet width size of a sheet bundle discharged is larger than a predetermined size L is determined by the CPU circuit portion 150.

If it is determined that the width of a sheet bundle to be bound is larger than a previously set width L (S3001: YES) in step S3001, the procedure proceeds to step S3002, in which the press unit 1200 is moved to a large size sheet receiving position (see FIG. 5) on the front side of the apparatus.

On the other hand, if it is determined that the width of the sheet bundle to be bound is smaller than the preliminarily set width L (S3001: NO) in step S3001, the procedure proceeds to step S3006. In step S3006, the press unit 1200 is moved to a near small size sheet receiving position (see FIG. 7). The near sheet receiving position is rear side of the apparatus near the home position of the press unit 1200 when the power is turned ON. If a next job described later is present, the near sheet receiving position for a next job is a sheet receiving position near standby position (sheet bundle discharge enable position) when the process of pressing the fold line is terminated in last job. The sheet receiving position and standby position (sheet bundle discharge enable position) are exchanged for each job between the rear side of the apparatus and the front side of the apparatus.

After that, the procedure proceeds to step S3003 in any case. In step S3003, the system stands by until the sheet bundle is accommodated in the press unit 1200. After that, the procedure proceeds to step S3004 after the sheet bundle is conveyed into the press unit 1200.

In step S3004, the press unit 1200 is moved and the folded portion of the sheet bundle is pressed. When the folded portion of the sheet bundle is pressed, the procedure proceeds to step S3005, in which whether or not a next job is present is determined by the CPU circuit portion 150.

If it is determined that a next job is present in step S3005, the procedure returns to step S3001, in which necessary process of steps S3001-S3006 equal to those described above is executed repeatedly until any job disappears. Then, when it is determined that a next job does not exist in step S3005, the control of the finisher is terminated.

The embodiment of the present invention has been described specifically above. The present invention is not restricted to the above-described embodiment but may be modified in various ways based on the technical philosophy of the present invention. For example, the quantity of sheets, sheet bundle and structure of the image forming apparatus mentioned in the above embodiment are just an example and these elements may be different corresponding to a necessity.

Although according to the above embodiment, the standby position of the press unit 1200 in standby condition is set to the rear side of the apparatus, this position may be set to the front side by changing the structure of the press unit 1200.

The scope of the following claims is to be accorded the broadest interpretation so as to encompass all such modifications and equivalent structures and functions.

This application claims the benefit of Japanese Patent Application No. 2005-252032, filed on 31 Aug. 2005, which is hereby incorporated by reference herein in its entirety.

What is claimed is:

1. A sheet processing apparatus comprising:

a folding unit which folds a sheet bundle comprised of a plurality of sheets;

a discharge portion which discharges the sheet bundle folded by the folding unit;

a sheet bundle pressurizing unit which is capable of pressurizing a folded portion of the folded sheet bundle when it moves from one end portion of the sheet bundle to the other end portion, or from the other end portion to the one end portion along the folded portion of the folded sheet bundle;

a housing which supports the sheet bundle pressurizing unit disposed at a position offset to the one end portion from a center of the housing in a moving direction of the sheet bundle pressurizing unit; and a controller which controls the sheet bundle pressurizing unit, wherein the sheet bundle pressurizing unit is movable to a sheet bundle discharge enable position where the folded sheet bundle after being pressurized is permitted to be discharged by the discharge portion with the folded portion thereof as a leading portion, and if the sheet size in a direction perpendicular to the direction of discharging the sheet bundle to be processed is larger than a predetermined size, the controller controls such that the sheet bundle discharge enable position of the sheet bundle pressurizing unit is set to the one end portion side.

2. An image forming apparatus comprising:

an image forming portion which forms an image on a sheet; and the sheet processing apparatus according to claim 1 which processes a sheet on which an image is formed.

3. A sheet processing apparatus comprising:

a folding unit which folds a sheet bundle comprised of a plurality of sheets;

a conveying portion which conveys the sheet bundle folded by the folding unit;

a sheet bundle pressurizing unit which is capable of pressurizing a folded portion of the folded sheet bundle conveyed by the conveying portion with the folded portion thereof as a leading portion when it moves from one end portion of the folded sheet bundle to the other end portion, or from the other end portion to the one end portion along the folded portion of the folded sheet bundle; and a controller which controls the sheet bundle pressurizing unit, wherein if the sheet size in the direction perpendicular to the conveying direction of the sheet bundle to be processed is larger than a predetermined size, the controller controls the moving direction of the sheet bundle pressurizing unit at the time of pressurization to either one direction or the opposite direction along the folded portion, and if the sheet size in the direction perpendicular to the conveying direction of the sheet bundle to be processed is smaller than the predetermined size, the controller controls the moving direction of the sheet bundle pressurizing unit at the time of pressurization to both directions opposite to each other along the folded portion.

4. An image forming apparatus comprising:

an image forming portion which forms an image on a sheet; and the sheet processing apparatus according to claim 3 which processes a sheet on which an image is formed.

5. A sheet processing apparatus comprising:

a folding unit which folds a sheet bundle comprised of a plurality of sheets;

a conveying portion which conveys the sheet bundle folded by the folding unit;

a sheet bundle pressurizing unit which is capable of pressurizing a folded portion of the folded sheet bundle when it moves from one end portion of the sheet bundle to the other end portion, or form the other end portion to the one end portion along the folded portion of the folded sheet bundle; and a controller which controls the sheet bundle pressurizing unit, wherein the sheet bundle pressurizing unit is movable between a sheet bundle receiving position for receiving the folded sheet bundle conveyed by the conveying portion with the folded portion thereof as a leading portion and a sheet bundle discharge enable position where the folded sheet bundle after being pressurized is permitted to be discharged by the conveying portion with the folded portion thereof as a leading portion, the controller is capable of exchanging the sheet receiving position and the sheet bundle discharge enable position between the one end portion and the other end portion;

if any sheet size in a direction perpendicular to the conveying direction of the sheet bundle to be processed continuously is larger than a predetermined size, the controller controls such that the sheet bundle discharge enables position of the sheet bundle pressurizing unit is set to one end portion side, and if any sheet size in the direction perpendicular to the conveying direction of the sheet bundle to be processed continuously is smaller than the predetermined size, the controller controls the sheet bundle discharge enable position of a preceding sheet bundle and the sheet bundle receiving position of a subsequent sheet bundle to be set on the same end portion side of the sheet bundle.

6. An image forming apparatus comprising:

an image forming portion which forms an image on a sheet; and the sheet processing apparatus according to claim 5 which processes a sheet on which an image is formed.

7. An image forming apparatus comprising:

an image forming portion which forms an image on a sheet;

a folding unit which folds a sheet bundle comprised of a plurality of sheets on which an image is formed;

a discharge portion which discharges the sheet bundle folded by the folding unit;

a sheet bundle pressurizing unit which is capable of pressurizing a folded portion of the folded sheet bundle when it moves from one end portion of the sheet bundle to the other end portion, or from the other end portion to the one end portion along the folded portion of the folded sheet bundle;

a housing which supports the sheet bundle pressurizing unit disposed at a position offset to the one end portion from a center of the housing in a moving direction of the sheet bundle pressurizing unit; and a controller which controls the sheet bundle pressurizing unit, wherein the sheet bundle pressurizing unit is movable to a sheet bundle discharge enable position where the folded sheet bundle after being pressurized is permitted to be discharged by the discharge portion with the folded portion thereof as a leading portion, and if the sheet size in a direction perpendicular to the direction of discharging the sheet bundle to be processed is larger than a predetermined size, the controller controls such that the sheet bundle discharge enable position of the sheet bundle pressurizing unit is set to the one end portion side.

8. An image forming apparatus comprising:

an image forming portion which forms an image on a sheet;

a folding unit which folds a sheet bundle comprised of a plurality of sheets on which an image is formed;

a conveying portion which conveys the sheet bundle folded by the folding unit;

a sheet bundle pressurizing unit which is capable of pressurizing a folded portion of the folded sheet bundle conveyed by the conveying portion with the folded portion thereof as a leading portion when it moves from one end portion of the folded sheet bundle to the other end portion, or from the other end portion to the one end portion along the folded portion of the folded sheet bundle; and a controller which controls the sheet bundle pressurizing unit, wherein if the sheet size in the direction perpendicular to the conveying direction of the sheet bundle to be processed is larger than a predetermined size, the controller controls the moving direction of the sheet bundle pressurizing unit at the time of pressurization to either one direction or the opposite direction along the folded portion, and if the sheet size in the direction perpendicular to the direction of receiving the sheet bundle to be processed is smaller than the predetermined size, the controller controls the moving direction of the sheet bundle pressurizing unit at the time of pressurization to both directions opposite to each other along the folded portion.

9. An image forming apparatus comprising:

an image forming portion which forms an image on a sheet;

a folding unit which folds a sheet bundle comprised of a plurality of sheets on which an image is formed;

a conveying portion which conveys the sheet bundle folded by the folding unit;

a sheet bundle pressurizing unit which is capable of pressurizing a folded portion of the folded sheet bundle when it moves from one end portion of the sheet bundle to the other end portion, or from the other end portion to the one end portion along the folded portion of the folded sheet bundle; and a controller which controls the sheet bundle pressurizing unit, wherein the sheet bundle pressurizing unit is movable between a sheet bundle receiving position for receiving the folded sheet bundle is conveyed by the conveying portion with the folded portion thereof as a leading portion and a sheet bundle discharge enable position where the sheet bundle after being pressurized is permitted to be discharged by conveying portion with the folded portion thereof as a leading portion, the controller is capable of exchanging the sheet receiving position and the sheet bundle discharge enable position between the one end portion and the other end portion, if any sheet size in a direction perpendicular to the conveying direction of the sheet bundle to be processed continuously is larger than a predetermined size, the controller controls such that the sheet bundle discharge enable position of the sheet bundle pressurizing unit is set to the one end portion side, and if any sheet size in the direction perpendicular to the conveying direction of the sheet bundle to be processed continuously is smaller than the predetermined size, the controller controls the sheet bundle discharge enable position of a preceding sheet bundle and the sheet bundle receiving position of a subsequent sheet bundle to be set on the same end portion side of the sheet bundle.

* * * * *